US009651227B2

(12) United States Patent
Pickard et al.

(10) Patent No.: US 9,651,227 B2
(45) Date of Patent: May 16, 2017

(54) LOW-PROFILE LIGHTING SYSTEM HAVING PIVOTABLE LIGHTING ENCLOSURE

(71) Applicant: EcoSense Lighting Inc., Los Angeles, CA (US)

(72) Inventors: Paul Pickard, Acton, CA (US); Robert Fletcher, Pasadena, CA (US); Edward R Adams, Englewood, TN (US)

(73) Assignee: ECOSENSE LIGHTING INC., Los Angeles, CA (US)

( * ) Notice: Subject to any disclaimer, the term of this patent is extended or adjusted under 35 U.S.C. 154(b) by 60 days.

(21) Appl. No.: 14/636,205

(22) Filed: Mar. 3, 2015

(65) Prior Publication Data

US 2016/0258602 A1 Sep. 8, 2016

(51) Int. Cl.
*F21V 9/00* (2015.01)
*F21V 19/02* (2006.01)
(Continued)

(52) U.S. Cl.
CPC ..... *F21V 19/02* (2013.01); *F21V 13/04* (2013.01); *F21V 14/02* (2013.01); *F21V 21/30* (2013.01);
(Continued)

(58) Field of Classification Search
None
See application file for complete search history.

(56) References Cited

U.S. PATENT DOCUMENTS 2,430,472 A 11/1947 Levy
D149,124 S 3/1948 Hewitt
(Continued)

FOREIGN PATENT DOCUMENTS

CA 2623604 A1 8/2009
CN 1536686 A 10/2004
(Continued)

OTHER PUBLICATIONS

Petluri et al., U.S. Appl. No. 14/526,504, filed Oct. 28, 2014, entitled "Lighting Systems Having Multiple Light Sources," 92pp.
(Continued)

*Primary Examiner* — Britt D Hanley
(74) *Attorney, Agent, or Firm* — Jay M. Brown

(57) ABSTRACT

Lighting system including first and second enclosures, and pivotable joint assembly. First enclosure is elongated along first longitudinal axis and configured for mounting array of plurality of lighting modules; and includes: two opposing end panels spaced apart along first axis; first and second spaced-apart pairs of opposing elongated side panels; and four elongated enclosure edges joining together first and second pairs of side panels. Second enclosure is elongated along second longitudinal axis and configured for containing lighting module power supply; and includes: two opposing end panels spaced apart along second axis; third and fourth spaced-apart pairs of opposing elongated side panels; and four elongated enclosure edges joining together third and fourth pairs of side panels. Pivotable joint assembly has pivotable joint axis parallel with first and second axes; is interposed between edges; and configured for constraining movement of first and second axes as around and parallel with pivotable joint axis.

47 Claims, 13 Drawing Sheets

(51) Int. Cl.

| | |
|---|---|
| ***F21V 13/04*** | (2006.01) |
| ***F21V 21/30*** | (2006.01) |
| ***F21V 14/02*** | (2006.01) |
| *F21V 7/00* | (2006.01) |
| *F21V 23/02* | (2006.01) |
| *F21Y 103/10* | (2016.01) |
| *F21Y 115/10* | (2016.01) |

(52) U.S. Cl.

CPC ..... *F21V 7/0083* (2013.01); *F21V 23/023* (2013.01); *F21Y 2103/10* (2016.08); *F21Y 2115/10* (2016.08)

(56) References Cited

U.S. PATENT DOCUMENTS

| | | | |
|---|---|---|---|
| D152,113 | S | 12/1948 | Mehr |
| 2,458,967 | A | 1/1949 | Wiedenhoeft |
| 2,678,380 | A | 5/1954 | Westby |
| 2,702,378 | A | 2/1955 | Talty |
| D191,734 | S | 11/1961 | Daher |
| 3,040,170 | A | 6/1962 | Chwan |
| 3,078,366 | A | 2/1963 | Winkler |
| 3,120,929 | A | 2/1964 | Henning |
| 3,220,471 | A | 11/1965 | Coe |
| 3,247,368 | A | 4/1966 | McHugh |
| 3,435,891 | A | 4/1969 | Parrish |
| D214,582 | S | 7/1969 | Routh |
| D217,096 | S | 4/1970 | Birns |
| 3,538,321 | A | 11/1970 | Longenecker |
| 3,639,751 | A | 2/1972 | Pichel |
| 3,643,038 | A | 2/1972 | Sato |
| D231,559 | S | 4/1974 | Darling et al. |
| D234,712 | S | 4/1975 | Kennedy et al. |
| 3,989,976 | A | 11/1976 | Tabor |
| 4,090,210 | A | 5/1978 | Wehling et al. |
| 4,091,444 | A | 5/1978 | Mori |
| D250,289 | S | 11/1978 | Dacal |
| 4,138,716 | A | 2/1979 | Muhlethaler et al. |
| D251,500 | S | 4/1979 | Aigner |
| 4,258,413 | A | 3/1981 | Mausser |
| 4,345,306 | A | 8/1982 | Summey |
| 4,414,489 | A | 11/1983 | Young |
| 4,420,207 | A | 12/1983 | Nishikawa |
| 4,423,471 | A | 12/1983 | Gordin et al. |
| 4,445,164 | A | 4/1984 | Giles, III |
| 4,453,203 | A | 6/1984 | Pate |
| 4,467,403 | A | 8/1984 | May |
| 4,473,873 | A | 9/1984 | Quiogue |
| D280,025 | S | 8/1985 | Waters |
| 4,564,888 | A | 1/1986 | Lewin |
| 4,578,742 | A | 3/1986 | Klein |
| 4,580,859 | A | 4/1986 | Frano |
| 4,609,979 | A | 9/1986 | Kristofek |
| 4,674,015 | A | 6/1987 | Smith |
| 4,727,648 | A | 3/1988 | Savage |
| 4,733,335 | A | 3/1988 | Serizawa |
| D296,717 | S | 7/1988 | Kane et al. |
| 4,755,918 | A | 7/1988 | Pristash |
| 4,757,431 | A | 7/1988 | Cross |
| 4,761,721 | A | 8/1988 | Willing |
| D300,876 | S | 4/1989 | Sakai |
| 4,833,579 | A | 5/1989 | Skegin |
| 4,837,927 | A | 6/1989 | Savage |
| 4,870,327 | A | 9/1989 | Jorgensen |
| 4,872,097 | A | 10/1989 | Miller |
| 4,882,667 | A | 11/1989 | Skegin |
| 4,918,497 | A | 4/1990 | Edmond |
| D308,114 | S | 5/1990 | Shemitz |
| D308,260 | S | 5/1990 | Shemitz |
| 4,966,862 | A | 10/1990 | Edmond |
| D315,030 | S | 2/1991 | Jacobs et al. |
| D316,303 | S | 4/1991 | Layne |
| D316,306 | S | 4/1991 | Shemitz |
| 5,027,168 | A | 6/1991 | Edmond |
| D319,512 | S | 8/1991 | Lettenmayer |
| D322,862 | S | 12/1991 | Miller |
| 5,087,212 | A | 2/1992 | Hanami |
| D325,645 | S | 4/1992 | Grange |
| 5,140,507 | A | 8/1992 | Harwood |
| D330,944 | S | 11/1992 | Wereley |
| 5,174,649 | A | 12/1992 | Alston |
| 5,177,404 | A | 1/1993 | Cohen |
| 5,210,051 | A | 5/1993 | Carter, Jr. |
| D336,536 | S | 6/1993 | Shaanan et al. |
| 5,235,470 | A | 8/1993 | Cheng |
| D340,514 | S | 10/1993 | Liao |
| 5,253,152 | A | 10/1993 | Yang |
| 5,282,364 | A | 2/1994 | Cech |
| 5,303,124 | A | 4/1994 | Wrobel |
| 5,324,213 | A | 6/1994 | Frantz |
| 5,325,281 | A | 6/1994 | Harwood |
| D348,744 | S | 7/1994 | Johnson et al. |
| 5,335,159 | A | 8/1994 | Chen et al. |
| 5,337,225 | A | 8/1994 | Brookman |
| 5,338,944 | A | 8/1994 | Edmond et al. |
| 5,359,345 | A | 10/1994 | Hunter |
| 5,367,229 | A | 11/1994 | Yang |
| 5,381,323 | A | 1/1995 | Osteen et al. |
| 5,387,901 | A | 2/1995 | Hardt |
| 5,393,993 | A | 2/1995 | Edmond et al. |
| 5,410,462 | A | 4/1995 | Wolfe |
| 5,416,342 | A | 5/1995 | Edmond et al. |
| 5,436,809 | A | 7/1995 | Brassier |
| 5,440,466 | A | 8/1995 | Belisle |
| 5,450,303 | A | 9/1995 | Markiewicz et al. |
| 5,490,048 | A | 2/1996 | Brassier |
| 5,504,665 | A | 4/1996 | Osteen et al. |
| 5,515,253 | A | 5/1996 | Sjobom |
| 5,516,390 | A | 5/1996 | Tomita et al. |
| 5,523,589 | A | 6/1996 | Edmond et al. |
| D373,437 | S | 9/1996 | Kira |
| 5,584,574 | A | 12/1996 | Haddad |
| 5,599,091 | A | 2/1997 | Kira |
| 5,604,135 | A | 2/1997 | Edmond et al. |
| 5,628,557 | A | 5/1997 | Huang |
| 5,631,190 | A | 5/1997 | Negley |
| 5,632,551 | A | 5/1997 | Roney |
| 5,634,822 | A | 6/1997 | Gunell |
| 5,655,832 | A | 8/1997 | Pelka |
| 5,658,066 | A | 8/1997 | Hirsch |
| D383,236 | S | 9/1997 | Krogman |
| D384,336 | S | 9/1997 | Gerber |
| D384,762 | S | 10/1997 | Roorda |
| 5,676,453 | A | 10/1997 | Parkyn, Jr. |
| D390,992 | S | 2/1998 | Shemitz |
| 5,713,662 | A | 2/1998 | Kira |
| 5,739,554 | A | 4/1998 | Edmond et al. |
| 5,757,144 | A | 5/1998 | Nilssen |
| 5,788,533 | A | 8/1998 | Alvarado-Rodriguez |
| 5,794,685 | A | 8/1998 | Dean |
| 5,800,050 | A | 9/1998 | Leadford |
| 5,806,955 | A | 9/1998 | Parkyn, Jr. |
| D408,823 | S | 4/1999 | Kirby |
| 5,890,793 | A | 4/1999 | Stephens |
| 5,894,196 | A | 4/1999 | McDermott |
| 5,898,267 | A | 4/1999 | McDermott |
| 5,909,955 | A | 6/1999 | Roorda |
| 5,912,477 | A | 6/1999 | Negley |
| 5,938,316 | A | 8/1999 | Yan |
| 5,971,571 | A * | 10/1999 | Rose ..... F21S 8/043 359/853 |
| 6,022,119 | A * | 2/2000 | Booty, Jr. ..... F21V 27/00 362/419 |
| 6,022,130 | A | 2/2000 | Donato |
| 6,051,940 | A | 4/2000 | Arun |
| 6,072,160 | A | 6/2000 | Bahl |
| 6,079,851 | A | 6/2000 | Altman |
| 6,083,021 | A | 7/2000 | Lau |
| 6,104,536 | A | 8/2000 | Eckhardt |
| 6,120,600 | A | 9/2000 | Edmond et al. |
| 6,124,673 | A | 9/2000 | Bishop |
| 6,149,112 | A | 11/2000 | Thieltges |
| 6,149,288 | A | 11/2000 | Huang |

(56) References Cited

U.S. PATENT DOCUMENTS 6,176,594 B1 1/2001 Yarconi
D437,449 S 2/2001 Soller
D437,652 S 2/2001 Uhler
6,187,606 B1 2/2001 Edmond et al.
6,196,705 B1 * 3/2001 Finke ..... F21V 21/26 362/276
6,198,233 B1 3/2001 McConaughy
6,201,262 B1 3/2001 Edmond et al.
D443,710 S 6/2001 Chiu
6,244,877 B1 6/2001 Asao
6,249,375 B1 6/2001 Silhengst
D445,936 S 7/2001 Mier-Langner et al.
6,260,981 B1 7/2001 Fiene
D446,592 S 8/2001 Leen
6,273,588 B1 8/2001 Arakelian
D448,508 S 9/2001 Benghozi
6,312,787 B1 11/2001 Hayashi et al.
6,318,883 B1 11/2001 Sugiyama et al.
D452,843 S 1/2002 Henrici
6,341,523 B2 1/2002 Lynam
D457,673 S 5/2002 Martinson
6,386,723 B1 5/2002 Eberlein et al.
6,390,646 B1 5/2002 Yan
6,392,360 B2 5/2002 McConaughy
6,426,704 B1 7/2002 Hutchison
6,435,693 B1 8/2002 Fiene
6,439,736 B1 8/2002 Fiene
6,439,743 B1 8/2002 Hutchison
6,439,749 B1 8/2002 Miller et al.
6,441,943 B1 8/2002 Roberts
D462,801 S 9/2002 Huang
6,450,662 B1 9/2002 Hutchison
6,450,664 B1 9/2002 Kelly
D464,455 S 10/2002 Fong
D464,939 S 10/2002 Chuang
D465,046 S 10/2002 Layne
6,473,002 B1 10/2002 Hutchison
6,474,839 B1 11/2002 Hutchison
6,478,453 B2 11/2002 Lammers
6,488,386 B1 12/2002 Yan
6,508,567 B1 1/2003 Fiene
D470,962 S 2/2003 Chen
6,525,939 B2 2/2003 Liang
D472,339 S 3/2003 Russello et al.
6,527,422 B1 3/2003 Hutchison
6,530,674 B2 3/2003 Grierson et al.
D473,529 S 4/2003 Feinbloom
6,540,382 B1 4/2003 Simon
6,561,690 B2 5/2003 Balestriero et al.
D476,439 S 6/2003 O'Rourke
6,600,175 B1 7/2003 Baretz et al.
6,601,970 B2 8/2003 Ueda
6,618,231 B2 9/2003 McConaughy
6,632,006 B1 10/2003 Rippel
6,636,003 B2 10/2003 Rahm et al.
D482,476 S 11/2003 Kwong
6,641,284 B2 11/2003 Stopa et al.
6,644,829 B1 * 11/2003 Tracy ..... F21V 21/30 362/220
6,662,211 B1 12/2003 Weller
6,682,211 B2 1/2004 English
6,683,419 B2 1/2004 Kriparos
6,691,768 B2 2/2004 Hsieh
6,703,640 B1 3/2004 Hembree
6,733,164 B1 5/2004 Smith, Jr.
D491,306 S 6/2004 Zucker
6,744,693 B2 6/2004 Brockmann
6,752,645 B2 6/2004 Nakamura
6,773,138 B2 8/2004 Coushaine
6,787,999 B2 9/2004 Stimac
6,788,510 B2 9/2004 McConaughy
6,791,119 B2 9/2004 Slater, Jr. et al.
6,814,462 B1 11/2004 Fiene
6,824,296 B2 11/2004 Souza
6,824,390 B2 11/2004 Brown
6,827,469 B2 12/2004 Coushaine
6,853,010 B2 2/2005 Slater, Jr. et al.
6,860,617 B2 3/2005 Fiene
6,863,424 B2 3/2005 Smith
6,864,513 B2 3/2005 Lin
6,869,206 B2 3/2005 Zimmerman
6,871,993 B2 3/2005 Hecht
D504,967 S 5/2005 Kung
6,893,144 B2 5/2005 Fan
D506,065 S 6/2005 Sugino
6,902,200 B1 6/2005 Beadle
6,902,291 B2 6/2005 Rizkin
6,903,380 B2 6/2005 Barnett
6,905,232 B2 6/2005 Lin
6,946,806 B1 9/2005 Choi
6,958,497 B2 10/2005 Emerson et al.
6,966,677 B2 11/2005 Galli
6,979,097 B2 12/2005 Elam
D516,020 S 2/2006 Wong
D516,229 S 2/2006 Tang
6,998,650 B1 2/2006 Wu
7,040,774 B2 5/2006 Beeson et al.
7,063,130 B2 6/2006 Huang
7,063,440 B2 6/2006 Mohacsi et al.
7,066,617 B2 6/2006 Mandy
D524,975 S 7/2006 Oas
7,070,301 B2 7/2006 Magarill
7,077,546 B2 7/2006 Yamauchi
D527,119 S 8/2006 Maxik
D527,131 S 8/2006 McCarthy, III
7,093,958 B2 8/2006 Coushaine
7,095,056 B2 8/2006 Vitta et al.
7,097,332 B2 8/2006 Vamberi
7,098,397 B2 8/2006 Lange
7,111,963 B2 9/2006 Zhang
7,111,971 B2 9/2006 Coushaine
7,112,916 B2 9/2006 Goh
D530,683 S 10/2006 Rivas
7,131,749 B2 11/2006 Wimberly
7,132,804 B2 11/2006 Lys
7,138,667 B2 11/2006 Barnett
7,149,089 B2 12/2006 Blasko
7,150,553 B2 12/2006 English
D535,774 S 1/2007 Weston et al.
7,159,997 B2 1/2007 Reo et al.
7,160,004 B2 1/2007 Peck
7,172,319 B2 2/2007 Holder et al.
D538,951 S 3/2007 Maxik
D539,459 S 3/2007 Benghozi
7,198,386 B2 4/2007 Zampini
7,207,696 B1 4/2007 Lin
D541,957 S 5/2007 Wang
7,210,957 B2 5/2007 Mrakovich et al.
7,213,940 B1 5/2007 Van De Ven et al.
7,221,374 B2 5/2007 Dixon
D544,110 S 6/2007 Hooker
D545,457 S 6/2007 Chen
7,234,950 B1 6/2007 Wickett
7,237,930 B2 7/2007 Onishi et al.
D548,691 S 8/2007 Krieger
7,273,299 B2 9/2007 Parkyn et al.
D552,779 S 10/2007 Starck
7,282,840 B2 10/2007 Chih
7,286,296 B2 10/2007 Chaves
7,288,902 B1 10/2007 Melanson
7,293,908 B2 11/2007 Beeson et al.
7,303,301 B2 12/2007 Koren
D561,924 S 2/2008 Yiu
D563,013 S 2/2008 Levine
7,329,907 B2 2/2008 Pang et al.
D564,119 S 3/2008 Metlen
7,344,279 B2 3/2008 Mueller
7,344,296 B2 3/2008 Matsui
7,357,534 B2 4/2008 Snyder
7,358,657 B2 4/2008 Koelger
7,358,679 B2 4/2008 Lys et al.
7,360,925 B2 4/2008 Coushaine
D568,829 S 5/2008 Yamashita
7,369,386 B2 5/2008 Rasmussen

(56) References Cited

U.S. PATENT DOCUMENTS

| | | | |
|---|---|---|---|
| D570,505 | S | 6/2008 | Maxik |
| 7,381,942 | B2 | 6/2008 | Chin et al. |
| D574,095 | S | 7/2008 | Hill |
| 7,396,139 | B2 | 7/2008 | Savage |
| 7,396,146 | B2 | 7/2008 | Wang |
| 7,413,326 | B2 | 8/2008 | Tain |
| D576,545 | S | 9/2008 | Mandel |
| D576,964 | S | 9/2008 | Shaner |
| D577,453 | S | 9/2008 | Metlen |
| D577,836 | S | 9/2008 | Engebrigtsen |
| 7,422,347 | B2 | 9/2008 | Miyairi et al. |
| D579,421 | S | 10/2008 | Chu |
| D581,080 | S | 11/2008 | Mier-Langner |
| D581,554 | S | 11/2008 | To |
| D581,583 | S | 11/2008 | Peng |
| 7,452,115 | B2 | 11/2008 | Alcelik |
| 7,456,499 | B2 | 11/2008 | Loh et al. |
| D583,975 | S | 12/2008 | Kushinskaya et al. |
| 7,458,820 | B2 | 12/2008 | Ohta |
| 7,467,888 | B2 | 12/2008 | Fiene |
| D585,588 | S | 1/2009 | Alexander |
| D585,589 | S | 1/2009 | Alexander |
| 7,481,552 | B2 | 1/2009 | Mayfield, III et al. |
| D586,498 | S | 2/2009 | Wu |
| D587,389 | S | 2/2009 | Benensohn |
| 7,494,248 | B2 | 2/2009 | Li |
| 7,497,581 | B2 | 3/2009 | Beeson et al. |
| 7,513,675 | B2 | 4/2009 | Mier-Langner |
| D591,894 | S | 5/2009 | Flank |
| D592,799 | S | 5/2009 | Scott |
| 7,532,324 | B2 | 5/2009 | Liu et al. |
| 7,537,464 | B2 | 5/2009 | Brandenburg |
| 7,539,028 | B2 | 5/2009 | Baurle et al. |
| D593,512 | S | 6/2009 | Lin |
| 7,540,761 | B2 | 6/2009 | Weber |
| 7,549,786 | B2 | 6/2009 | Higley |
| D597,246 | S | 7/2009 | Meyer, IV |
| D597,247 | S | 7/2009 | Meyer, IV |
| 7,559,784 | B2 | 7/2009 | Hsiao |
| 7,564,180 | B2 | 7/2009 | Brandes |
| D597,704 | S | 8/2009 | Peng |
| D599,040 | S | 8/2009 | Alexander |
| 7,575,332 | B2 | 8/2009 | Cok |
| 7,575,338 | B1 | 8/2009 | Verfuerth |
| 7,580,192 | B1 | 8/2009 | Chu |
| D601,276 | S | 9/2009 | Grajcar |
| 7,591,572 | B1 | 9/2009 | Levine |
| 7,594,738 | B1 | 9/2009 | Lin |
| D602,868 | S | 10/2009 | Vogt |
| 7,604,365 | B2 | 10/2009 | Chang |
| 7,607,802 | B2 | 10/2009 | Kang |
| D604,870 | S | 11/2009 | Hong |
| 7,621,770 | B1 | 11/2009 | Finizio |
| 7,626,345 | B2 | 12/2009 | Young |
| 7,628,506 | B2 | 12/2009 | Verfuerth |
| 7,637,635 | B2 | 12/2009 | Xiao |
| D608,043 | S | 1/2010 | Ko |
| D610,543 | S | 2/2010 | Coushaine |
| D610,723 | S | 2/2010 | Grajcar |
| D610,729 | S | 2/2010 | Kushinskaya et al. |
| 7,665,862 | B2 | 2/2010 | Villard |
| 7,674,018 | B2 | 3/2010 | Holder et al. |
| 7,679,281 | B2 | 3/2010 | Kim et al. |
| 7,686,481 | B1 | 3/2010 | Condon et al. |
| 7,690,810 | B2 | 4/2010 | Saitoh et al. |
| 7,703,951 | B2 | 4/2010 | Piepgras |
| 7,722,227 | B2 | 5/2010 | Zhang |
| 7,727,009 | B2 | 6/2010 | Goto |
| 7,731,395 | B2 | 6/2010 | Parkyn et al. |
| 7,731,396 | B2 | 6/2010 | Fay |
| 7,736,029 | B2 | 6/2010 | Chen et al. |
| 7,737,634 | B2 | 6/2010 | Leng et al. |
| 7,740,380 | B2 | 6/2010 | Thrailkill |
| 7,744,259 | B2 | 6/2010 | Walczak |
| 7,744,266 | B2 | 6/2010 | Higley |
| 7,748,870 | B2 | 7/2010 | Chang |
| 7,759,881 | B1 | 7/2010 | Melanson |
| 7,766,508 | B2 | 8/2010 | Villard et al. |
| 7,766,518 | B2 | 8/2010 | Piepgras |
| 7,784,966 | B2 | 8/2010 | Verfuerth |
| 7,785,124 | B2 | 8/2010 | Lin |
| D625,870 | S | 10/2010 | Feigenbaum |
| D626,094 | S | 10/2010 | Alexander |
| 7,806,562 | B2 | 10/2010 | Behr |
| 7,810,951 | B1 | 10/2010 | Lee et al. |
| 7,810,955 | B2 | 10/2010 | Stimac et al. |
| 7,810,995 | B2 | 10/2010 | Fadler et al. |
| 7,813,111 | B2 | 10/2010 | Anderson |
| 7,819,549 | B2 | 10/2010 | Narendran et al. |
| D627,507 | S | 11/2010 | Lai |
| D627,727 | S | 11/2010 | Alexander |
| D628,156 | S | 11/2010 | Alexander |
| 7,828,576 | B2 | 11/2010 | Lin |
| 7,837,348 | B2 | 11/2010 | Narendran et al. |
| 7,841,753 | B2 | 11/2010 | Liu |
| D629,365 | S | 12/2010 | Garcia De Vicuna |
| 7,845,393 | B2 | 12/2010 | Kao |
| 7,857,482 | B2 | 12/2010 | Reo et al. |
| 7,857,498 | B2 | 12/2010 | Smith |
| 7,866,850 | B2 | 1/2011 | Alexander |
| 7,874,700 | B2 | 1/2011 | Patrick |
| D633,244 | S | 2/2011 | Kramer et al. |
| D633,248 | S | 2/2011 | Alexander |
| 7,889,421 | B2 | 2/2011 | Narendran |
| 7,896,517 | B2 | 3/2011 | Mandy |
| 7,901,108 | B2 | 3/2011 | Kabuki et al. |
| 7,914,162 | B1 | 3/2011 | Huang |
| 7,914,198 | B2 | 3/2011 | Mier-Langner |
| 7,918,581 | B2 | 4/2011 | Van De Ven |
| 7,918,589 | B2 | 4/2011 | Mayfield, III et al. |
| 7,922,364 | B2 | 4/2011 | Tessnow |
| 7,923,907 | B2 | 4/2011 | Tessnow |
| 7,942,559 | B2 | 5/2011 | Holder et al. |
| 7,952,114 | B2 | 5/2011 | Gingrich, III |
| 7,965,494 | B1 | 6/2011 | Morris |
| 7,972,038 | B2 | 7/2011 | Albright |
| 7,972,054 | B2 | 7/2011 | Alexander |
| 7,976,194 | B2 | 7/2011 | Wilcox et al. |
| 7,985,005 | B2 | 7/2011 | Alexander |
| 7,988,336 | B1 | 8/2011 | Harbers |
| 7,993,031 | B2 | 8/2011 | Grajcar |
| 8,002,438 | B2 | 8/2011 | Ko |
| 8,007,131 | B2 | 8/2011 | Liu et al. |
| D645,007 | S | 9/2011 | Alexander |
| D645,594 | S | 9/2011 | Grawe |
| 8,021,008 | B2 | 9/2011 | Ramer |
| 8,029,157 | B2 | 10/2011 | Li et al. |
| 8,033,680 | B2 | 10/2011 | Sharrah |
| 8,052,310 | B2 | 11/2011 | Gingrinch, III |
| 8,066,403 | B2 | 11/2011 | Sanfilippo et al. |
| D650,504 | S | 12/2011 | Kim et al. |
| D650,935 | S | 12/2011 | Beghelli |
| 8,080,819 | B2 | 12/2011 | Mueller et al. |
| 8,083,364 | B2 | 12/2011 | Allen |
| 8,096,668 | B2 | 1/2012 | Abu-Ageel |
| 8,100,560 | B2 | 1/2012 | Ahland, III et al. |
| 8,100,564 | B2 | 1/2012 | Ono |
| 8,102,167 | B2 | 1/2012 | Irissou et al. |
| 8,102,683 | B2 | 1/2012 | Gaknoki et al. |
| D654,607 | S | 2/2012 | Kim et al. |
| 8,118,450 | B2 | 2/2012 | Villard |
| 8,118,454 | B2 | 2/2012 | Rains, Jr. et al. |
| 8,123,376 | B2 | 2/2012 | Van De Ven et al. |
| 8,125,776 | B2 | 2/2012 | Alexander |
| D655,432 | S | 3/2012 | Beghelli |
| D655,840 | S | 3/2012 | Heaton et al. |
| D655,842 | S | 3/2012 | Sabernig |
| 8,129,669 | B2 | 3/2012 | Chen et al. |
| 8,136,958 | B2 | 3/2012 | Verfuerth |
| 8,138,690 | B2 | 3/2012 | Chemel et al. |
| 8,142,047 | B2 | 3/2012 | Acampora et al. |
| 8,143,803 | B2 | 3/2012 | Beij et al. |
| 8,152,336 | B2 | 4/2012 | Alexander |
| 8,154,864 | B1 | 4/2012 | Nearman |

(56) References Cited

U.S. PATENT DOCUMENTS 8,162,498 B2 4/2012 Ramer et al.
D659,871 S 5/2012 Lee et al.
D660,229 S 5/2012 Tseng
8,172,425 B2 5/2012 Wen et al.
8,172,436 B2 5/2012 Coleman
8,177,395 B2 5/2012 Alexander
8,182,122 B2 5/2012 Chiu
8,191,613 B2 6/2012 Yuan
8,193,738 B2 6/2012 Chu et al.
8,201,965 B2 6/2012 Yamada
8,205,998 B2 6/2012 Ramer et al.
8,210,722 B2 7/2012 Holder et al.
8,212,469 B2 7/2012 Rains, Jr. et al.
8,215,798 B2 7/2012 Rains, Jr. et al.
8,232,745 B2 7/2012 Chemel et al.
D665,340 S 8/2012 Obata
8,242,766 B2 8/2012 Gaknoki et al.
8,292,482 B2 10/2012 Harbers
8,297,788 B2 10/2012 Bishop
8,297,792 B1 10/2012 Wang
8,297,808 B2 10/2012 Yuan
8,319,437 B2 11/2012 Carlin
8,324,838 B2 12/2012 Shah et al.
8,330,378 B2 12/2012 Maehara et al.
8,337,043 B2 12/2012 Verfuerth
8,344,602 B2 1/2013 Lai
8,360,609 B2 1/2013 Lee et al.
8,360,621 B2 1/2013 Avila et al.
8,385,071 B2 2/2013 Lin
8,403,541 B1 3/2013 Rashidi
8,410,716 B2 4/2013 Yao et al.
8,414,178 B2 4/2013 Alexander
8,434,898 B2 5/2013 Sanfilippo et al.
8,436,556 B2 5/2013 Eisele et al.
8,454,193 B2 6/2013 Simon et al.
8,459,841 B2 6/2013 Huang
8,462,523 B2 6/2013 Gaknoki et al.
8,469,542 B2 6/2013 Zampini, II et al.
8,503,083 B2 8/2013 Seo
8,529,102 B2 9/2013 Pickard et al.
8,531,134 B2 9/2013 Chemel et al.
8,536,802 B2 9/2013 Chemel et al.
8,536,805 B2 9/2013 Shah et al.
8,543,249 B2 9/2013 Chemel et al.
D690,859 S 10/2013 Mollaghaffari
8,545,045 B2 10/2013 Tress
8,545,049 B2 10/2013 Davis et al.
8,547,034 B2 10/2013 Melanson et al.
8,552,664 B2 10/2013 Chemel et al.
8,556,469 B2 10/2013 Pickard
8,558,518 B2 10/2013 Irissou et al.
8,562,180 B2 10/2013 Alexander
8,569,972 B2 10/2013 Melanson
D693,514 S 11/2013 Mueller
8,573,807 B2 11/2013 Borkar et al.
8,573,816 B2 11/2013 Negley et al.
8,575,858 B2 11/2013 Policy et al.
8,579,467 B1 11/2013 Szeto
8,581,504 B2 11/2013 Kost et al.
8,581,521 B2 11/2013 Welten et al.
8,585,245 B2 11/2013 Black et al.
8,587,211 B2 11/2013 Melanson
8,593,074 B2 11/2013 Hatley et al.
8,593,129 B2 11/2013 Gaknoki et al.
8,593,814 B2 11/2013 Ji
D694,925 S 12/2013 Fukasawa
8,598,809 B2 12/2013 Negley et al.
8,602,591 B2 12/2013 Lee
8,610,364 B2 12/2013 Melanson et al.
8,610,365 B2 12/2013 King et al.
8,611,106 B2 12/2013 Fang
8,616,724 B2 12/2013 Pickard
8,624,505 B2 1/2014 Huang
D699,179 S 2/2014 Alexander
8,643,038 B2 2/2014 Collins
8,646,944 B2 2/2014 Villard
8,646,949 B2 2/2014 Brunt, Jr. et al.
8,652,357 B2 2/2014 Ryu
8,653,750 B2 2/2014 Deurenberg et al.
D700,728 S 3/2014 Fukasawa
8,684,556 B2 4/2014 Negley et al.
8,684,569 B2 4/2014 Pickard et al.
8,690,383 B2 4/2014 Zampini, II et al.
8,698,421 B2 4/2014 Ludorf
D704,369 S 5/2014 Lindsley et al.
8,723,427 B2 5/2014 Collins et al.
8,740,444 B2 6/2014 Reynolds et al.
8,742,684 B2 6/2014 Melanson
8,749,131 B2 6/2014 Rains, Jr. et al.
8,749,173 B1 6/2014 Melanson et al.
8,757,840 B2 6/2014 Pickard et al.
8,760,073 B2 6/2014 Ko
8,760,080 B2 6/2014 Yu
8,764,225 B2 7/2014 Narendran et al.
8,777,455 B2 7/2014 Pickard et al.
8,783,938 B2 7/2014 Alexander
8,786,201 B2 7/2014 Hamamoto et al.
8,786,210 B2 7/2014 DeLucia
8,786,211 B2 7/2014 Gilliom
8,786,212 B2 7/2014 Terazawa
8,786,213 B2 7/2014 Yang et al.
8,791,642 B2 7/2014 Van De Ven
8,794,792 B1 8/2014 Moghal
8,796,948 B2 8/2014 Weaver
8,810,227 B2 8/2014 Flaibani et al.
8,814,385 B2 8/2014 Onaka et al.
8,816,593 B2 8/2014 Lys et al.
8,820,964 B2 9/2014 Gould
8,836,226 B2 9/2014 Mercier et al.
8,840,278 B2 9/2014 Pickard
8,847,515 B2 9/2014 King et al.
D715,466 S 10/2014 Wang
8,853,958 B2 10/2014 Athalye et al.
8,858,028 B2 10/2014 Kim
8,876,322 B2 11/2014 Alexander
8,888,315 B2 11/2014 Edwards et al.
8,888,506 B2 11/2014 Nishimura
8,901,838 B2 12/2014 Akiyama et al.
8,944,647 B2 2/2015 Bueeler
D724,773 S 3/2015 Ryu
8,970,101 B2 3/2015 Sutardja
9,010,967 B2 4/2015 Jensen
9,052,100 B2 6/2015 Blackstone
9,307,588 B2 4/2016 Li
D764,092 S 8/2016 Cai
2001/0006463 A1 7/2001 Fischer
2001/0053628 A1 12/2001 Hayakawa
2002/0046826 A1 4/2002 Kao
2002/0067613 A1 6/2002 Grove
2002/0106925 A1 8/2002 Yamagishi
2002/0117692 A1 8/2002 Lin
2003/0026091 A1* 2/2003 Shemitz ..... A47F 11/10 362/125
2003/0058658 A1 3/2003 Lee
2003/0072156 A1 4/2003 Pohlert
2003/0128543 A1 7/2003 Rekow
2003/0137835 A1* 7/2003 Mier-Langner ..... F21S 8/06 362/220
2003/0174517 A1 9/2003 Kiraly et al.
2003/0185005 A1 10/2003 Sommers
2003/0209963 A1 11/2003 Altgilbers
2003/0227772 A1* 12/2003 Yoshida ..... F21V 21/30 362/147
2004/0005800 A1 1/2004 Hou
2004/0090781 A1 5/2004 Yeoh
2004/0090784 A1 5/2004 Ward
2004/0212991 A1 10/2004 Galli
2004/0218372 A1 11/2004 Hamasaki
2005/0032402 A1 2/2005 Takanashi
2005/0047170 A1 3/2005 Hilburger
2005/0083698 A1 4/2005 Zampini
2005/0122713 A1 6/2005 Hutchins
2005/0130336 A1 6/2005 Collins, III
2005/0146884 A1 7/2005 Scheithauer

(56) References Cited

U.S. PATENT DOCUMENTS

2005/0174780 A1 8/2005 Park
2005/0205878 A1 9/2005 Kan
2005/0242362 A1 11/2005 Shimizu
2005/0269060 A1 12/2005 Ku
2005/0270775 A1 12/2005 Harbers
2005/0286265 A1 12/2005 Zampini et al.
2006/0001381 A1 1/2006 Robinson
2006/0039156 A1 2/2006 Chen
2006/0062019 A1 3/2006 Young
2006/0076672 A1 4/2006 Petroski
2006/0141851 A1 6/2006 Matsui
2006/0146422 A1 7/2006 Koike
2006/0146531 A1 7/2006 Reo et al.
2006/0152140 A1 7/2006 Brandes
2006/0221272 A1 10/2006 Negley et al.
2006/0262544 A1 11/2006 Piepgras
2006/0262545 A1 11/2006 Piepgras
2007/0025103 A1 2/2007 Chan
2007/0064428 A1 3/2007 Beauchamp
2007/0096057 A1 5/2007 Hampden-Smith
2007/0109795 A1 5/2007 Gabrius
2007/0139923 A1 6/2007 Negley et al.
2007/0153521 A1 7/2007 Konuma
2007/0158668 A1 7/2007 Tarsa et al.
2007/0170447 A1 7/2007 Negley et al.
2007/0171653 A1* 7/2007 Bingaman ..... F21V 15/015 362/346
2007/0171659 A1* 7/2007 Tickner ..... F21V 21/30 362/371
2007/0223219 A1 9/2007 Medendorp, Jr. et al.
2007/0238327 A1 10/2007 Hsu
2007/0242461 A1 10/2007 Reisenauer
2007/0253201 A1 11/2007 Blincoe
2007/0253202 A1 11/2007 Wu
2007/0253209 A1 11/2007 Loh et al.
2007/0268698 A1 11/2007 Chen et al.
2007/0269915 A1 11/2007 Leong et al.
2007/0275576 A1 11/2007 Yang
2007/0285028 A1 12/2007 Tsinker et al.
2007/0295969 A1 12/2007 Chew et al.
2007/0297177 A1 12/2007 Wang
2008/0012036 A1 1/2008 Loh et al.
2008/0013316 A1 1/2008 Chiang
2008/0043470 A1 2/2008 Wimberly
2008/0076272 A1 3/2008 Hsu
2008/0080190 A1 4/2008 Walczak
2008/0084700 A1 4/2008 Van De Ven
2008/0106907 A1 5/2008 Trott
2008/0112121 A1 5/2008 Cheng
2008/0117500 A1 5/2008 Narendran et al.
2008/0121921 A1 5/2008 Loh et al.
2008/0130275 A1 6/2008 Higley
2008/0142194 A1 6/2008 Zhou
2008/0157112 A1 7/2008 He
2008/0158881 A1 7/2008 Liu
2008/0158887 A1 7/2008 Zhu
2008/0165530 A1 7/2008 Hendrikus
2008/0173884 A1 7/2008 Chitnis et al.
2008/0179611 A1 7/2008 Chitnis et al.
2008/0192478 A1 8/2008 Chen
2008/0198112 A1 8/2008 Roberts
2008/0219002 A1 9/2008 Sommers et al.
2008/0219303 A1 9/2008 Chen et al.
2008/0224598 A1 9/2008 Baretz
2008/0224631 A1 9/2008 Melanson
2008/0274641 A1 11/2008 Weber
2008/0308825 A1 12/2008 Chakraborty et al.
2009/0021936 A1 1/2009 Stimac et al.
2009/0026913 A1 1/2009 Mrakovich
2009/0034283 A1 2/2009 Albright
2009/0046464 A1 2/2009 Liu
2009/0050907 A1 2/2009 Yuan et al.
2009/0050908 A1 2/2009 Yuan et al.
2009/0052158 A1 2/2009 Bierhuizen
2009/0080185 A1 3/2009 McMillan
2009/0086474 A1 4/2009 Chou
2009/0091935 A1 4/2009 Tsai
2009/0103299 A1 4/2009 Boyer et al.
2009/0129084 A1 5/2009 Tsao
2009/0141500 A1 6/2009 Peng
2009/0154166 A1 6/2009 Zhang
2009/0167203 A1 7/2009 Dahlman et al.
2009/0180276 A1 7/2009 Benitez
2009/0184616 A1 7/2009 Van De Ven et al.
2009/0195168 A1 8/2009 Greenfeld
2009/0225551 A1 9/2009 Chang et al.
2009/0236997 A1 9/2009 Liu
2009/0294114 A1 12/2009 Yang
2009/0296388 A1 12/2009 Wu et al.
2009/0310354 A1 12/2009 Zampini, II et al.
2009/0317988 A1 12/2009 Lin
2010/0015821 A1 1/2010 Hsu
2010/0019697 A1 1/2010 Korsunsky
2010/0026158 A1 2/2010 Wu
2010/0027258 A1 2/2010 Maxik
2010/0060202 A1 3/2010 Melanson et al.
2010/0072505 A1 3/2010 Gingrich, III
2010/0073783 A1 3/2010 Sun
2010/0073884 A1 3/2010 Peloza
2010/0091487 A1 4/2010 Shin
2010/0091497 A1 4/2010 Chen
2010/0102696 A1 4/2010 Sun
2010/0110684 A1 5/2010 Abdelsamed et al.
2010/0110728 A1 5/2010 Dubrow et al.
2010/0128484 A1 5/2010 Peng
2010/0132918 A1 6/2010 Lin
2010/0141173 A1 6/2010 Negrete
2010/0142189 A1 6/2010 Hong
2010/0149818 A1 6/2010 Ruffin
2010/0157605 A1 6/2010 Chang
2010/0174345 A1 7/2010 Ashdown
2010/0195323 A1 8/2010 Schaefer et al.
2010/0230709 A1 9/2010 Kanno
2010/0238630 A1 9/2010 Xu
2010/0243219 A1 9/2010 Yang
2010/0246179 A1 9/2010 Long
2010/0260945 A1 10/2010 Kites
2010/0284181 A1 11/2010 O'Brien et al.
2010/0296289 A1 11/2010 Villard et al.
2010/0301360 A1 12/2010 Van De Ven
2010/0301774 A1 12/2010 Chemel et al.
2010/0308742 A1 12/2010 Melanson
2010/0319953 A1 12/2010 Yochum
2011/0002120 A1* 1/2011 Song ..... F21S 2/005 362/249.02
2011/0013397 A1 1/2011 Catone et al.
2011/0043129 A1 2/2011 Koolen
2011/0044046 A1 2/2011 Abu-Ageel
2011/0049749 A1 3/2011 Bailey
2011/0050100 A1 3/2011 Bailey
2011/0050101 A1 3/2011 Bailey
2011/0050124 A1 3/2011 Bailey
2011/0051407 A1 3/2011 St. Ives et al.
2011/0051414 A1 3/2011 Bailey
2011/0090684 A1 4/2011 Logan et al.
2011/0097921 A1 4/2011 Hsu
2011/0103070 A1 5/2011 Zhang et al.
2011/0115381 A1 5/2011 Carlin
2011/0122643 A1 5/2011 Spork
2011/0134634 A1 6/2011 Gingrich, III
2011/0136374 A1 6/2011 Mostoller
2011/0140620 A1 6/2011 Lin et al.
2011/0180841 A1 7/2011 Chang
2011/0193490 A1 8/2011 Kumar
2011/0210360 A1 9/2011 Negley
2011/0222270 A1 9/2011 Porciatti
2011/0222277 A1 9/2011 Negley
2011/0253358 A1 10/2011 Huang
2011/0255287 A1 10/2011 Li
2011/0273079 A1 11/2011 Pickard
2011/0279015 A1 11/2011 Negley
2011/0285308 A1 11/2011 Crystal
2011/0285314 A1 11/2011 Carney et al.
2011/0292483 A1 12/2011 Pakhchyan et al.

(56) References Cited

U.S. PATENT DOCUMENTS

| | | | |
|---|---|---|---|
| 2011/0306219 | A1 | 12/2011 | Swanger |
| 2011/0309773 | A1 | 12/2011 | Beers |
| 2011/0316441 | A1 | 12/2011 | Huynh |
| 2011/0316446 | A1 | 12/2011 | Kang et al. |
| 2012/0002417 | A1 | 1/2012 | Li |
| 2012/0014115 | A1 | 1/2012 | Park et al. |
| 2012/0018754 | A1 | 1/2012 | Lowes |
| 2012/0019127 | A1 | 1/2012 | Hirosaki |
| 2012/0021623 | A1 | 1/2012 | Gorman |
| 2012/0025729 | A1 | 2/2012 | Melanson et al. |
| 2012/0038280 | A1 | 2/2012 | Zoorob et al. |
| 2012/0038291 | A1 | 2/2012 | Hasnain |
| 2012/0051048 | A1 | 3/2012 | Smit |
| 2012/0051056 | A1 | 3/2012 | Derks |
| 2012/0051068 | A1 | 3/2012 | Pelton |
| 2012/0092860 | A1 | 4/2012 | Blackstone |
| 2012/0106152 | A1 | 5/2012 | Zheng |
| 2012/0112661 | A1 | 5/2012 | Van De Ven |
| 2012/0119658 | A1 | 5/2012 | McDaniel |
| 2012/0140468 | A1 | 6/2012 | Chang |
| 2012/0140474 | A1 | 6/2012 | Jurik et al. |
| 2012/0146519 | A1 | 6/2012 | Briggs |
| 2012/0169242 | A1 | 7/2012 | Olson |
| 2012/0175653 | A1 | 7/2012 | Weber |
| 2012/0187830 | A1 | 7/2012 | Shum |
| 2012/0188757 | A1 | 7/2012 | Villard |
| 2012/0223657 | A1 | 9/2012 | Van De Ven |
| 2012/0224177 | A1 | 9/2012 | Harbers et al. |
| 2012/0236553 | A1 | 9/2012 | Cash |
| 2012/0250309 | A1 | 10/2012 | Handsaker |
| 2012/0268894 | A1 | 10/2012 | Alexander |
| 2012/0286304 | A1 | 11/2012 | Letoquin |
| 2012/0286319 | A1 | 11/2012 | Lee |
| 2012/0287642 | A1 | 11/2012 | Zeng |
| 2012/0292660 | A1 | 11/2012 | Kanno |
| 2012/0307487 | A1 | 12/2012 | Eckel |
| 2012/0307494 | A1 | 12/2012 | Zlotnikov et al. |
| 2012/0313124 | A1 | 12/2012 | Clatterbuck |
| 2013/0002167 | A1 | 1/2013 | Van De Ven |
| 2013/0003370 | A1 | 1/2013 | Watanabe |
| 2013/0003388 | A1 | 1/2013 | Jensen |
| 2013/0026942 | A1 | 1/2013 | Ryan |
| 2013/0042510 | A1 | 2/2013 | Nall et al. |
| 2013/0049602 | A1 | 2/2013 | Raj |
| 2013/0049603 | A1 | 2/2013 | Bradford |
| 2013/0049627 | A1 | 2/2013 | Roberts |
| 2013/0069561 | A1 | 3/2013 | Melanson et al. |
| 2013/0070441 | A1 | 3/2013 | Moon |
| 2013/0070442 | A1 | 3/2013 | Negley |
| 2013/0082612 | A1 | 4/2013 | Kim |
| 2013/0083510 | A1 | 4/2013 | Park |
| 2013/0094225 | A1 | 4/2013 | Leichner |
| 2013/0095673 | A1 | 4/2013 | Brandon |
| 2013/0140490 | A1 | 6/2013 | Fujinaga |
| 2013/0162140 | A1 | 6/2013 | Shamoto et al. |
| 2013/0170220 | A1 | 7/2013 | Bueeler |
| 2013/0170221 | A1 | 7/2013 | Isogai et al. |
| 2013/0176728 | A1 | 7/2013 | Bizzotto et al. |
| 2013/0193869 | A1 | 8/2013 | Hong et al. |
| 2013/0221489 | A1 | 8/2013 | Cao et al. |
| 2013/0229114 | A1 | 9/2013 | Eisele et al. |
| 2013/0229804 | A1 | 9/2013 | Holder et al. |
| 2013/0235555 | A1 | 9/2013 | Tanaka |
| 2013/0235579 | A1 | 9/2013 | Smith |
| 2013/0235580 | A1 | 9/2013 | Smith |
| 2013/0241392 | A1 | 9/2013 | Pickard et al. |
| 2013/0241440 | A1 | 9/2013 | Gaknoki et al. |
| 2013/0249434 | A1 | 9/2013 | Medendorp |
| 2013/0250573 | A1 | 9/2013 | Taskar et al. |
| 2013/0250581 | A1 | 9/2013 | Tang et al. |
| 2013/0258636 | A1 | 10/2013 | Rettke |
| 2013/0265777 | A1 | 10/2013 | Zollers et al. |
| 2013/0300303 | A1 | 11/2013 | Liu |
| 2013/0301252 | A1 | 11/2013 | Hussell et al. |
| 2013/0322072 | A1 | 12/2013 | Pu et al. |
| 2014/0015419 | A1 | 1/2014 | Shah et al. |
| 2014/0016318 | A1 | 1/2014 | Pokrajac |
| 2014/0036510 | A1 | 2/2014 | Preston et al. |
| 2014/0043813 | A1 | 2/2014 | Dube' et al. |
| 2014/0048743 | A1 | 2/2014 | Le-Mercier |
| 2014/0049241 | A1 | 2/2014 | Gaknoki et al. |
| 2014/0049962 | A1 | 2/2014 | Holder et al. |
| 2014/0055038 | A1 | 2/2014 | Cappitelli et al. |
| 2014/0055054 | A1 | 2/2014 | Borkar et al. |
| 2014/0062330 | A1 | 3/2014 | Neundorfer |
| 2014/0063779 | A1 | 3/2014 | Bradford |
| 2014/0071685 | A1 | 3/2014 | Black et al. |
| 2014/0071696 | A1 | 3/2014 | Park, II et al. |
| 2014/0078715 | A1 | 3/2014 | Pickard et al. |
| 2014/0078722 | A1 | 3/2014 | Caldwell et al. |
| 2014/0078746 | A1 | 3/2014 | Caldwell et al. |
| 2014/0103796 | A1 | 4/2014 | Jansen |
| 2014/0126205 | A1 | 5/2014 | Davis et al. |
| 2014/0126224 | A1 | 5/2014 | Brunt, Jr. et al. |
| 2014/0134880 | A1 | 5/2014 | Yeh |
| 2014/0140052 | A1 | 5/2014 | Villard |
| 2014/0159077 | A1 | 6/2014 | Kuenzler |
| 2014/0159600 | A1 | 6/2014 | Sutardja |
| 2014/0167601 | A1 | 6/2014 | Harry |
| 2014/0167646 | A1 | 6/2014 | Zukauskas et al. |
| 2014/0176016 | A1 | 6/2014 | Li |
| 2014/0198531 | A1 | 7/2014 | Iwasaki |
| 2014/0217433 | A1 | 8/2014 | Tudorica |
| 2014/0217907 | A1 | 8/2014 | Harris |
| 2014/0218909 | A1 | 8/2014 | Tetsuo et al. |
| 2014/0225511 | A1 | 8/2014 | Pickard et al. |
| 2014/0225532 | A1 | 8/2014 | Groeneveld |
| 2014/0233193 | A1 | 8/2014 | Alexander |
| 2014/0268631 | A1 | 9/2014 | Pickard |
| 2014/0268724 | A1 | 9/2014 | Yanping |
| 2014/0268737 | A1 | 9/2014 | Athalye et al. |
| 2014/0286016 | A1 | 9/2014 | Montagne |
| 2014/0286018 | A1 | 9/2014 | Zhang et al. |
| 2014/0361701 | A1 | 12/2014 | Siessegger et al. |
| 2014/0367633 | A1 | 12/2014 | Bibl |
| 2015/0002034 | A1 | 1/2015 | Van De Ven |
| 2015/0029717 | A1 | 1/2015 | Shen et al. |
| 2015/0036339 | A1 | 2/2015 | Ashdown et al. |
| 2015/0043218 | A1 | 2/2015 | Hu |
| 2015/0060922 | A1 | 3/2015 | Wilcox |
| 2015/0236225 | A1 | 8/2015 | David |
| 2015/0295144 | A1 | 10/2015 | Weiler |
| 2016/0174319 | A1 | 6/2016 | Li |

FOREIGN PATENT DOCUMENTS

| | | | |
|---|---|---|---|
| CN | 201739849 | A | 2/2011 |
| CN | 202040752 | A | 11/2011 |
| CN | 102269351 | A | 12/2011 |
| GB | 2457016 | A | 8/2009 |
| JP | 61-070306 | U | 5/1986 |
| JP | 2003-092022 | A | 3/2003 |
| JP | 2004-179048 | A | 6/2004 |
| JP | 2004-265626 | A | 9/2004 |
| JP | 2005-017554 | A | 1/2005 |
| JP | 2005-071818 | A | 3/2005 |
| JP | 2005-235778 | A | 9/2005 |
| JP | 2005-267964 | A | 9/2005 |
| JP | 2006-236796 | A | 9/2006 |
| JP | 2006-253274 | A | 9/2006 |
| JP | 2006-310138 | A | 11/2006 |
| JP | D1307268 | B | 8/2007 |
| JP | D1307434 | B | 8/2007 |
| JP | 2007-273205 | A | 10/2007 |
| JP | 2007-273209 | A | 10/2007 |
| JP | 2011-508406 | A | 3/2011 |
| JP | 2011-204495 | A | 10/2011 |
| JP | 2011-204658 | A | 10/2011 |
| KR | 1020070039683 | A | 4/2007 |
| KR | 1020090013704 | A | 2/2009 |
| KR | 100974942 | B1 | 8/2010 |
| KR | 1020120050280 | A | 5/2012 |
| TW | 2004-25542 | A | 11/2004 |
| TW | 290967 | M | 5/2006 |

(56) References Cited

FOREIGN PATENT DOCUMENTS

| | | | |
|---|---|---|---|
| TW | 296481 | M | 8/2006 |
| TW | 1273858 | B | 2/2007 |
| TW | 1318461 | B | 12/2009 |
| WO | DM/057383 | B | 9/2001 |
| WO | 02/12788 | A1 | 2/2002 |
| WO | 02/15281 | A2 | 2/2002 |
| WO | 2004/071143 | A1 | 8/2004 |
| WO | 2005/093862 | A2 | 10/2005 |
| WO | 2006/066531 | A1 | 6/2006 |
| WO | 2006066531 | A1 | 6/2006 |
| WO | 2007/128070 | A1 | 11/2007 |
| WO | 2008/108832 | A1 | 9/2008 |
| WO | 2009/044330 | A1 | 4/2009 |
| WO | 2009108799 | A1 | 9/2009 |
| WO | 2009/120555 | A1 | 10/2009 |
| WO | 2010/016002 | A1 | 2/2010 |
| WO | 2010059647 | A1 | 5/2010 |
| WO | 2011019945 | A1 | 2/2011 |
| WO | 2013059298 | A1 | 4/2013 |
| WO | 2013192014 | A2 | 12/2013 |
| WO | 2013192014 | A3 | 12/2013 |
| WO | 2014099681 | A2 | 6/2014 |
| WO | 2014099681 | A3 | 12/2014 |

OTHER PUBLICATIONS

Petluri et al., U.S. Appl. No. 14/636,204, filed Mar. 3, 2015, entitled "Lighting Systems Including Lens Modules for Selectable Light Distribution," 119pp.

Pickard et al., U.S. Appl. No. 14/617,849, filed Feb. 9, 2015, entitled "Lighting Systems Generating controlled and Wavelength-Converted Light Emissions," 83pp.

Rodgers et al., U.S. Appl. No. 14/702,800, filed May 4, 2015, entitled "Lighting Systems Including Asymmetric Lens Modules for Selectable Light Distribution," 116pp.

Fletcher et al., U.S. Appl. No. 29/533,667, filed Jul. 20, 2015, entitled "LED Luminaire Having a Mounting System," 10pp.

Fletcher et al., U.S. Appl. No. 14/702,765, filed May 4, 2015, entitled "Lighting System Having a Sealing System," 92pp.

Fletcher et al., U.S. Appl. No. 29/519,149, filed Mar. 3, 2015, entitled "LED Luminaire," 8pp.

Fletcher et al., U.S. Appl. No. 29/519,153, filed Mar. 3, 2015, entitled "LED Luminaire," 8pp.

Fetcher et al., U.S. Appl. No. 14/816,827, filed Aug. 3, 2015, entitled "Lighting System Having a Mounting Device," 126pp.

Rodgers et al., U.S. Appl. No. 62/202,936, filed Aug. 10, 2015, entitled "Optical Devices and Systems Having a Converging Lens With Grooves," 133pp.

Fetcher et al., U.S. Appl. No. 29/532,383, filed Jul. 6, 2015, entitled "LED Luminaire Having a Mounting System," 10pp.

Fletcher et al., U.S. Appl. No. 29/533,635, filed Jul. 20, 2015, entitled "LED Luminaire Having a Mounting System," 10pp.

Fletcher et al., U.S. Appl. No. 29/533,666, filed Jul. 20, 2015, entitled "LED Luminaire Having a Mounting System," 10pp.

Knight, Colette, "XICATO—Investigations on the use of LED modules for optimized color appearance in retail applications," downloaded on May 28, 2014 from http://www.xicato.com/sites/default/files/documents/Summary_investigations_on_the_use_of LED_modules_for_optimized_color_appearance_in_retail_applications.pdf, 5pp.

"Zumtobel—IYON Tunable White,", downloaded on Oct. 19, 2015 from http://www.zumtobel.com/tunablewhite/en/index.html#topic_04, 1p.

"Zumtobel—IYON LED Spotlight Catalog," downloaded on Oct. 19, 2015 from http://www.zumtobel.com/PDB/Ressource/teaser/en/com/lyon.pdf, 40pp.

"Lumenpulse—Lumenbeam Large Pendant Dynamic White," downloaded on May 28, 2014 from http://www.lumenpulse.com/en/product/72/lumenbeam-large-pendant-dynamic-white, 1p.

"Lumileds Application Brief AB08—Optical Testing for SuperFlux, SnapLED and Luxeon Emitters," downloaded on Sep. 24, 2014 from www.lumileds.com, 15pp.

"CandlePowerForums—SOLD: Luxeon III side-emitter white LED," downloaded on May 28, 2014 from http://www.candlepowerforums.com/vb/showthread.php?140276-SOLD-Luxeon-III-side-emitter-white-LED, 4pp.

"Lumileds LUXEON Z,", downloaded on May 2, 2015 from www.lumileds.com, 2pp.

"Alanod Miro Catalog," downloaded on Jan. 30, 2015 from www.alanod.com, 8pp.

"Nanoco Group—Cadmium Free Quantum Dots," downloaded on May 30, 2014 from www.nanocotechnologies.com/what-we-do/products/cadmium-free-quantum-dots, 3pp.

"Nanosys—Quantum Dots," downloaded on May 30, 2014 from www.nanosysinc.com/what-we-do/quantum-dots/, 3pp.

"Ocean NanoTech—Products," downloaded on May 30, 2014 from www.oceannanotech.com/Products.php, 1p.

"NNCrystal—blog post—May 17, 2010," downloaded from http://led-lights-led.blogspot.com/2010/05/nncrystal-us-corporation-to-supply.html, 4pp.

"A Warmer, Cozier White Light: NXP Transforms LED Color Quality," dated Jan. 9, 2013, downloaded from http://www.nxp.com/news/press-releases/2013/01/a-warmer-cozier-white-light-nxp-transforms-led-color-quality.html, 2pp.

"Lighting Global Technical Notes, Optical Control Techniques for Off-grid Lighting Products," Jul. 2011 and May 2012, 6pp.

"Pacific Light Technologies—Quantum Dots in Solid State Lighting," downloaded on Oct. 23, 2015 from www.pacificlighttech.com/quantum-dots-in-ssl/, 2pp.

"Philips Lighting—Dim Tone,", downloaded on May 27, 2014 from www.usa.lighting.philips.com/lightcommunity/trends/led/dimtone/, 1p.

"Philips—Dimmable to warm light for the perfect ambience," downloaded on May 27, 2014 from www.usa.lighting.philips.com, 2pp.

"Philips—Turn up Ambience and Tone Down Energy Use with Philips BR30 DimTone," downloaded on May 27, 2014 from www.usa.lighting.philips.com, 11pp.

Wikipedia, "Planckian locus," downloaded on May 30, 2014 from www.wikipedia.org, 5pp.

Wikipedia, "Quantum dot,", downloaded on May 30, 2014 from http://en.wikipedia.org/wiki/Quantum_dot, 15pp.

"Phosphortech—Flexible Phosphor Sheet—RadiantFlex Datasheet," Aug. 2014, downloaded from www.phosphortech.com, 10pp.

Wikipedia, "Reflectivity,", downloaded on Jan. 22, 2015 from www.wikipedia.org, 3pp.

"Refraction by lenses," downloaded on Feb. 17, 2015 from www.physicsclassroom.com, 5pp.

"RTLED—White Paper: Binning and LED," downloaded on Oct. 13, 2014 from www.rtled.com, 3pp.

Near, Al, "Seeing Beyond CRI," LED Testing & Application, Nov. 2011, downloaded from www.ies.org/Ida/hottopics/led/4.pdf, 2pp.

"Selux—Olivio luminaire," press release dated Mar. 26, 2014, downloaded from http://www.selux.com/be/en/news/press/press-detail/article/evolutionary-progress-the-olivio-family-of-system-luminaires-now-with-premium-quality-white-and.html, 3pp.

"LEDIL—Strada-F Series," downloaded on May 5, 2015 from www.ledil.com, 7pp.

"Sylvania—ULTRA SE(tm) LED Lamp Family," downloaded on May 27, 2014 from www.sylvania.com, 3pp.

"Sylvania Ultra SE(tm) LED Light Bulbs with Color Dimming Sunset Effects," downloaded on May 27, 2014 from https://www.youtube.com/watch?v=oZEc-VfJ8EU, 2pp.

Wikipedia, "Transmittance," downloaded on Jan. 22, 2015 from www.wikipedia.org, 4pp.

"United Lumen—A Volumetric Displaced Phosphor Light Engine which elegantly and efficiently distributes light in a pattern similar to an incandescent bulb," downloaded on Jul. 9, 2014 from www.unitedlumen.com, 1p.

"United Lumen—Solid State Volumetric Technology," downloaded on Jul. 9, 2014 from www.unitedlumen.com, 1p.

(56) References Cited

OTHER PUBLICATIONS

"United Lumen—High Brightness V-LED Technology," downloaded on May 15, 2014 from www.unitedlumen.com, 1p.
"USAl Lighting Catalog," downloaded on May 27, 2014 from http://www.usaillumination.com/pdf/Warm_Glow_Dimming.pdf, 50pp.
"WINONA—Parata 700 Series Cove," downloaded on May 28, 2014 from www.acuitybrands.com, 2pp.
"WINONA PARATA Catalog," downloaded on May 28, 2014 from www.acuitybrands.com, 24pp.
PCT/US2007/023110, Journee Lighting Inc., International Preliminary Report on Patentability Dated Sep. 8, 2009.
PCT/US2009/035321, Journee Lighting Inc., International Preliminary Report on Patentability Dated Aug. 31, 2010.
PCT/US2009/064858, Journee Lighting Inc., International Preliminary Report on Patentability Dated May 24, 2011.
PCT/US2010/045361, Journee Lighting Inc., International Preliminary Report on Patentability Dated Feb. 14, 2012.
PCT/US2012/060588, Ecosense Lighting Inc., Filed on Oct. 17, 2012.
PCT/US2012/060588, Ecosense Lighting Inc., International Search Report and Opinion Dated Mar. 29, 2013.
PCT/US2012/060588, Ecosense Lighting Inc., International Preliminary Report on Patentability Dated Apr. 22, 2014.
PCT/US2013/045708, Journee Lighting Inc., International Search Report and Opinion Dated Nov. 27, 2013.
PCT/US2013/045708, Journee Lighting Inc., International Preliminary Report on Patentability Dated May 12, 2015.
PCT/US2013/075172, Ecosense Lighting Inc., Filed on Dec. 13, 2013.
PCT/US2013/075172, Ecosense Lighting Inc., International Search Report and Opinion Dated Sep. 26, 2014.
PCT/US2013/075172, Ecosense Lighting Inc., International Preliminary Report on Patentability Dated Jun. 23, 2015.
PCT/US2016/020521, Ecosense Lighting Inc., Filed on Mar. 2, 2016.
PCT/US2016/020521, Ecosense Lighting Inc., International Search Report and Opinion Dated May 3, 2016.
PCT/US2016/016972, Ecosense Lighting Inc., Filed on Feb. 8, 2016.
PCT/US2016/016972, Ecosense Lighting Inc., International Search Report and Opinion Dated Apr. 11, 2016.
PCT/US2016/030613, Ecosense Lighting Inc., Filed on May 3, 2016.
PCT/US2016/020523, Ecosense Lighting Inc., Filed on Mar. 2, 2016.
PCT/US2016/020523, Ecosense Lighting Inc., International Search Report and Opinion Dated May 6, 2016.
PCT/US2016/015470, Ecosense Lighting Inc., Filed on Jan. 28, 2016, Entitled "Zoned Optical Cup."
Petluri et al., U.S. Appl. No. 62/288,368, filed Jan. 28, 2016, entitled "Multizone Mixing Cup".
PCT/US2016/015473, Ecosense Lighting Inc., Filed on Jan. 28, 2016, Entitled "Illuminating With a Multizone Mixing Cup".
PCT/US2016/015473, Ecosense Lighting Inc., International Search Report and Opinion Mailed on Apr. 22, 2016.
Petluri et al., U.S. Appl. No. 15/170,806, filed Jun. 1, 2016, entitled "Illuminating With a Multizone Mixing Cup."
PCT/US2016/015318, Ecosense Lighting Inc., Filed on Jan. 28, 2016, Entitled "Compositions for LED Light Conversions."
PCT/US2016/015318, Ecosense Lighting Inc., International Search Report and Opinion, Mailed on Apr. 2016.
PCT/US2016/015348, Ecosense Lighting Inc., Filed on Jan. 28, 2016, Entitled "Systems for Providing Tunable White Light With High Color Rendering."
PCT/US2016/015348, Ecosense Lighting Inc., International Search Report and Opinion Mailed on Apr. 11, 2016.
PCT/US2016/015368, Ecosense Lighting Inc., Filed on Jan. 28, 2016, Entitled "Systems for Providing Tunable White Light With High Color Rendering."
PCT/US2016/015368, Ecosense Lighting Inc., International Search Report and Opinion Mailed on Apr. 19, 2016.
Petluri et al., U.S. Appl. No. 15/173,538, filed Jun. 3, 2016, entitled "System for Providing Tunable White Light With High Color Rendering."
Petluri et al., U.S. Appl. No. 15/173,554, filed Jun. 3, 2016, entitled "System for Providing Tunable White Light With High Color Rendering."
PCT/US2016/015385, Ecosense Lighting Inc., Filed on Jan. 28, 2016, Entitled "Methods for Generating Tunable White Light With High Color Rendering."
PCT/US2016/015402, Ecosense Lighting Inc., Filed on Jan. 28, 2016, Entitled "Methods for Generating Tunable White Light With High Color Rendering."
PCT/US2016/015435, Ecosense Lighting Inc., Filed on Jan. 28, 2016, Entitled "Methods for Generating Melatonin-Response-Tuned White Light With High Color Rendering."
PCT/US2016/015437, Ecosense Lighting Inc., Filed on Jan. 28, 2016, Entitled "Methods for Generating Melatonin-Response-Tuned White Light With High Color Rendering."
PCT/US2016/015441, Ecosense Lighting Inc., Filed on January 28, 2016, Entitled "Methods for Generating Melatonin-Response-Tuned White Light With High Color Rendering."
Petluri et al., U.S. Appl. No. 15/176,083, filed Jun. 7, 2016, entitled "Compositions for LED Light conversions."
PCT/US2016/030613, Ecosense Lighting Inc., International Search Report and Opinion Dated Aug. 5, 2016.
PCT/US2016/046245, Ecosense Lighting Inc., Filed on Aug. 10, 2016.
PCT/US2016/015470, Ecosense Lighting Inc., International Search Report and Opinion Dated Jul. 8, 2016.
PCT/US2016/015385, Ecosense Lighting Inc., International Search Report and Opinion Dated Apr. 8, 2016.
PCT/US2016/015402, Ecosense Lighting Inc., International Search Report and Opinion Dated Apr. 22, 2016.
PCT/US2016/015435, Ecosense Lighting Inc., International Search Report and Opinion Dated Mar. 31, 2016.
PCT/US2016/015437, Ecosense Lighting Inc., International Search Report and Opinion Dated Mar. 31, 2016.
PCT/US2016/015441, Ecosense Lighting Inc., International Search Report and Opinion Dated Mar. 31, 2016.
Notice of Allowance mailed on Sep. 29, 2016 in Fletcher U.S. Appl. No. 29/519,153, entitled "LED Luminaire Having Open and Closed Positions", 7 pages.
Acuity Brands, "Acuity Brands Introduces Luminaire for Tunable White Technology," downloaded from http://news.acuitybrands.com/US/acuity-brands-introduces-luminaires-with-tunable-white-technology/s/54ae242f-1222-4b8b-be0d-36637bde8cd2 on May 28, 2014, 2pp.
Acuity Brands Lighting Inc. Product Catalog, downloaded from www.acuitybrands.com, dated Apr. 2013, 90pp.
Acuity Brands, "A Guided Tour of Area Light Sources—Past, Present and Future," downloaded from www.acuitybrands.com, version dated Jun. 20, 2013, 72pp.
Alanod GmbH, "WhiteOptics," downloaded from www.alanod.com, dated Apr. 2014, 12pp.
Altman Lighting, "Spectra Cube," downloaded from http://altmanstagelighting.com/altman-led-green-lighting/led-spectra-cube/Altman-Spectra-Cube-Data-Sheet-v3.pdf on May 28, 2014, 1p.
Bega Lighting, "In-ground luminaire RGBW IP 67 Product data sheet," downloaded from http://www.bega.com/download/datenblaetter/en/7926.pdf on May 28, 2014, 1p.
CORM 2011 Conference, Gaithersburg, MD, "Calculation of CCT and Duv and Practical Conversion Formulae," dated May 3-5, 2011, National Institute of Standards and Technology, 28pp.
Lumitronix, "Carclo lens for side emitting 360 degrees," downloaded from http://www.leds.de/en/High-Power-LEDs/Lenses-and-optics/Carclo-lens-for-side-emitting-360.html on May 28, 2014, 2pp.
"Introduction to Catmull-Rom Splines," downloaded on Aug. 7, 2015 from www.mvps.org/directx/articles/catmull/, 2pp.

(56) References Cited

OTHER PUBLICATIONS

Wikipedia, "CIE 1931 color space," version dated Apr. 23, 2014, downloaded from www.wikipedia.org, 12pp.
Osram Sylvania, "ColorCalculator User Guide", downloaded on Jun. 3, 2014 from www.sylvania.com, 44pp.
Osram Sylvania, "ColorCalculator User Guide", downloaded on Oct. 19, 2015 from www.sylvania.com, 50pp.
Kenneth Kelly, "Color Designations for Lights," U.S. Department of Commerce, National Bureau of Standards, Research Paper RP1565, Journal of Research of the National Bureau of Standards, vol. 31, Nov. 1943, pp. 271-278.
Philips Color Kinetics, "LED Cove Lighting," downloaded on May 28, 2014 from http://www.colorkinetics.com/ls/guides-brochures/pck-led-cove-lighting.pdf, 32pp.
Philips Color Kinetics, "IntelliWhite LED Lighting Systems," downloaded on May 28, 2014 from http://www.colorkinetics.com/ls/intelliwhite/, 2pp.
Philips Color Kinetics, "Color-Changing LED Lighting Systems," downloaded on May 27, 2014 from http://www.colorkinetics.com/ls/rgb/, 2pp.
Wikipedia, "Color temperature," version dated May 21, 2014, downloaded on Jun. 3, 2014 from www.wikipedia.org, 17pp.
Cree, "LED Color Mixing: Basics and Background," downloaded on Sep. 24, 2014 from www.cree.com, 24pp.
Cree, "Cree(r) LMH2 LED Modules," Product Family Data Sheet, downloaded on May 27, 2014 from http://www.cree.com/~/media/Files/Cree/LED%20Components%20and%20Modules/Modules/Data%20Sheets/LEDModules_LMH2.pdf, 18pp.
"Dialight ES Series RGB LED Luminaire," downloaded on May 28, 2014 from http://www.dialight.com/Assets/Brochures_And_Catalogs/Illumination/MDEXESTEMORGB_A.pdf , 2pp.
Naomi Miller, "Color Spaces and Planckian Loci: Understanding all those Crazy Color Metrics," U.S. Department of Energy, Pacific Northwest National Laboratory, Portland, Oregon, downloaded on May 30, 2014, 49pp.
Kahen, Keith, "High-Efficiency Colloidal Quantum Dot Phosphors," University at Buffalo, SUNY, DOE SSL R&D Workshop, Long Beach, California, Jan. 29-31, 2013, 12pp.
Bush, Steve, "Chip gives dim-to-warm LED lighting without MCU," dated Apr. 1, 2014, downloaded from http://www.electronicsweekly.com/news/components/led-lighting/chip-gives-dim-warm-led-lighting-without-mcu-2014-04/, 6pp.
"Ecosense to reveal new TROV LED Linear Platform at 2015 Lightfair International in New York City," May 4, 2015, blog downloaded from www.ecosense.com, 3pp.
"Ecosense to reveal new TROV LED Linear Platform at 2015 Lightfair International in New York City," May 4, 2015, press release downloaded from www.ecosense.com, 2pp.
Freyssinier, Jean P. et al., "Class A Color Designation for Light Sources Used in General Illumination," J. Light & Vis. Env., vol. 37, Nos. 2-3, Nov. 7, 2013, pp. 10-14.
Freyssinier, Jean P. et al., "White Lighting: A Provisional Model for Predicting Perceived Tint in 'White' Illumination," Color Res. & App'n, vol. 39, No. 5, Oct. 2014, pp. 466-479.
Freyssinier, Jean P. et al., "The Class A Color Designation for Light Sources," Rensselaer Polytechnic Institute, 2013 DOE Solid-State Lighting R&D Workshop, Hilton Long Beach, California, Jan. 29-31, 2013, 26pp.
Freyssinier, Jean P. et al., "Class A Lighting," Rensselaer Polytechnic Institute, Strategies in Light 2012, 27 pp.
Freyssinier, Jean P. et al., "White Lighting," Color Res. & App'n, (volume unknown), Sep. 3, 2011, downloaded from http://www.lrc.rpi.edu/programs/solidstate/assist/pdf/SIL-2012_FreyssinierRea_WhiteLighting.pdf, 12pp.
Rea et al., "White lighting for residential applications," Lighting Res. Technol., Mar. 27, 2012, downloaded from www.sagepublications.com at http://lrt.sagepub.com/content/early/2012/03/27/1477153512442936, 15pp.
Oh, Jeong et al., "Full down-conversion of amber-emitting phosphor-converted light-emitting diodes with powder phosphors and a long-wave pass filter," Optics Express, vol. 18, No. 11, May 24, 2010, pp. 11063-11072.
"Microcellular Reflective Sheet MCPET," downloaded on Feb. 3, 2015 from www.furukawa.co.jp/foam/, 6pp.
"Aculux—Black Body Dimming and Tunable White Responsive Technologies," downloaded on May 28, 2014 from http://www.junolightinggroup.com/literature/LIT-AX-LED-BBD-TW.pdf, 28pp.
"Khatod—Symmetric & Asymmetric Strip Lens," downloaded on May 5, 2015 from www.khatod.com, 3pp.
"KKDC Catalog 2.0," downloaded on May 28, 2014 from http://www.kkdc.co.uk/media/kkdc-catalogue.pdf, 134pp.
"KKDC UK—Linear LED Lighting," downloaded from www.kkdc.co.uk/application/interior.php on Oct. 22, 2015, 5pp.
Overton, Gail, "LEDS: White LED comprises blue LED and inexpensive dye," LaserFocusWorld, Feb. 12, 2013, Downloaded from http://www.laserfocusworld.com/articles/print/volume-49/issue-02/world-news/leds--white-led-comprises-blue-led-and-inexpensive-dye.html, 5pp.
"LEDIL TIR Lens Guide," downloaded from www.ledil.com on Jan. 22, 2015, 8pp.
"LED Linear—linear lighting solutions, product overview," downloaded on May 28, 2014 from http://www.led-linear.com/en/product-overview/system-catalogue/, 3pp.
"LEDnovation—BR30 Warm Dimming," downloaded on May 28, 2014 from www.lednovation.com/products/BR30_LED.asp, 2pp.
Wikipedia, "Lenticular lens," downloaded on Feb. 18, 2015 from www.wikipedia.org, 5pp.
"Lenticular Sheets," downloaded on Feb. 24, 2015 from www.lenticular-sheets.lpceurope.eu/, 2pp.
Unzner, Norbert, "Light Analysis in lighting technology," B&S Electronische Geralte GmbH, 2001, 14pp.
"Lightolier—Solid-State Lighting," downloaded on May 28, 2014 from http://www.lightolier.com/prospots/leds_solidstate.jsp, 1p.
Wikipedia, "Line of purples," downloaded on Oct. 20, 2015 from www.wikipedia.org, 2pp.
"Lumenbeam Catalog," downloaded on May 27, 2014 from 11_160_en_lumenpulse_lumenbeam_rgb_lbl_rgb_brochure.zip, 63pp.
"Lumenetix—Araya Technology," downloaded on May 28, 2014 from www.lumenetix.com/araya-technology, 3pp.
"Lumenpulse—Lumenbeam Large Color Changing,", downloaded on May 27, 2014 from www.lumenpulse.com/en/product/11/lumenbeam-large-color-changing, 4pp.
"Lumenpulse—Lumencove Family," downloaded on May 28, 2014 from http://www.lumenpulse.com/en/products#!3/0/0/0/0/0, 2pp.
PCT/US2016/020523, Ecosense Lighting Inc., Filed on Mar. 2, 2016, Entitled "Low-Profile Lighting System Having Pivotable Lighting Enclosure."
PCT/US2016/020523, Ecosense Lighting Inc., International Search Report and Opinion Mailed on May 6, 2016.

* cited by examiner

LOW-PROFILE LIGHTING SYSTEM HAVING PIVOTABLE LIGHTING ENCLOSURE

BACKGROUND OF THE INVENTION

1. Field of the Invention

The present invention relates to the field of lighting systems that include semiconductor light-emitting devices.

2. Background of the Invention

Numerous lighting systems that include semiconductor light-emitting devices have been developed. As examples, some of such lighting systems may include an elongated housing for an array of a plurality of lighting modules. Despite the existence of these lighting systems, further improvements are still needed in lighting systems that include semiconductor light-emitting devices.

SUMMARY

In an example of an implementation, a lighting system is provided that includes: a first enclosure; a second enclosure; and a pivotable joint assembly. The first enclosure is elongated along a first longitudinal axis and is configured for mounting an array of a plurality of lighting modules. The first enclosure includes: two opposing end panels being spaced apart along the first longitudinal axis; a first spaced-apart pair of opposing elongated side panels; a second spaced-apart pair of opposing elongated side panels; and four elongated enclosure edges joining together the first and second pairs of the elongated side panels along the first longitudinal axis. The second enclosure is elongated along a second longitudinal axis and is configured for containing a lighting module power supply. The second enclosure includes: two additional opposing end panels being spaced apart along the second longitudinal axis; a third spaced-apart pair of opposing elongated side panels; a fourth spaced-apart pair of opposing elongated side panels; and four additional elongated enclosure edges joining together the third and fourth pairs of the elongated side panels along the second longitudinal axis. The pivotable joint assembly has a pivotable joint axis; and the pivotable joint axis is parallel with the first and second longitudinal axes. The pivotable joint assembly is interposed between a one of the elongated enclosure edges and a one of the additional elongated enclosure edges. The pivotable joint assembly is configured for constraining movement of the first longitudinal axis relative to the second longitudinal axis as being around and parallel with the pivotable joint axis.

In some examples of the lighting system, the pivotable joint assembly may be configured for permitting a one of the first spaced-apart pair of elongated side panels to face towards a one of the third spaced-apart pair of elongated side panels.

In further examples of the lighting system, the pivotable joint assembly may be configured for permitting a one of the second spaced-apart pair of elongated side panels to face towards a one of the fourth spaced-apart pair of elongated side panels.

In additional examples of the lighting system, configuring the pivotable joint assembly for permitting the one of the second spaced-apart pair of elongated side panels to face towards the one of the fourth spaced-apart pair of elongated side panels may include configuring the pivotable joint assembly for permitting the one of the first spaced-apart pair of elongated side panels to be rotated away from the one of the third spaced-apart pair of elongated side panels around the pivotable joint axis by an angle being within a range of between about 0 degrees and about 180 degrees.

In other examples of the lighting system, the one of the first spaced-apart pair of elongated side panels may include a first panel region having a generally flat profile, and the one of the third spaced-apart pair of elongated side panels may include a third panel region having a generally flat profile, and the pivotable joint assembly may be configured for permitting the one of the first spaced-apart pair of elongated side panels to be in direct contact with the one of the third spaced-apart pair of elongated side panels.

In some examples of the lighting system, the first panel region may have first dimensions including a first length along the first longitudinal axis, and a first width; and the third panel region may have third dimensions including a third length along the second longitudinal axis, and a third width; and the first width may be substantially the same as the third width.

In further examples of the lighting system, another one of the first spaced-apart pair of elongated side panels may include another first panel region having a generally flat profile, and another one of the third spaced-apart pair of elongated side panels may include another third panel region having a generally flat profile.

In additional examples of the lighting system, a one of the second spaced-apart pair of elongated side panels may include a second panel region having a generally flat profile, and a one of the fourth spaced-apart pair of elongated side panels may include a fourth panel region having a generally flat profile, and the pivotable joint assembly may be configured for permitting the one of the second spaced-apart pair of elongated side panels to be in direct contact with the one of the fourth spaced-apart pair of elongated side panels.

In other examples of the lighting system, the second panel region may have second dimensions including a second length along the first longitudinal axis, and a second width; and the fourth panel region may have fourth dimensions including a fourth length along the second longitudinal axis, and a fourth width; and the second width may be smaller than the fourth width.

In some examples of the lighting system, a combined width being a sum of the second and fourth widths of the lighting system may be within a range of between about 35 millimeters and about 50 millimeters.

In further examples of the lighting system, another one of the second spaced-apart pair of elongated side panels may include another second panel region having a generally flat profile, and another one of the fourth spaced-apart pair of elongated side panels may include another fourth panel region having a generally flat profile.

In additional examples of the lighting system, configuring the pivotable joint assembly for permitting the one of the second spaced-apart pair of elongated side panels to be in direct contact with the one of the fourth spaced-apart pair of elongated side panels may include configuring the pivotable joint assembly for permitting the one of the second spaced-apart pair of elongated side panels to be rotated toward the one of the fourth spaced-apart pair of elongated side panels around the pivotable joint axis by an angle being within a range of between about 0 degrees and about 180 degrees.

In other examples of the lighting system, the one of the third spaced-apart pair of elongated side panels may include a third panel region having a generally flat profile, and the second enclosure may be configured for mounting the lighting system by placing the one of the third spaced-apart pair of elongated side panels in contact with a support.

In some examples of the lighting system, another one of the third spaced-apart pair of elongated side panels may include another third panel region having a generally flat profile, and the second enclosure may be configured for mounting the lighting system by placing the another one of the third spaced-apart pair of elongated side panels in contact with a support.

In further examples of the lighting system, a one of the fourth spaced-apart pair of elongated side panels may include a fourth panel region having a generally flat profile, and the second enclosure may be configured for mounting the lighting system by placing the one of the fourth spaced-apart pair of elongated side panels in contact with a support.

In additional examples of the lighting system, a one of the first spaced-apart pair of elongated side panels may include a first panel region having a generally flat profile having first dimensions including a first length along the first longitudinal axis, and a first width; and a one of the second spaced-apart pair of elongated side panels may include a second panel region having a generally flat profile having second dimensions including a second length along the first longitudinal axis, and a second width; and the second width may be substantially smaller than the first width.

In other examples of the lighting system, a one of the third spaced-apart pair of elongated side panels may include a third panel region having a generally flat profile having third dimensions including a third length along the second longitudinal axis, and a third width; and a one of the fourth spaced-apart pair of elongated side panels may include a fourth panel region having a generally flat profile having fourth dimensions including a fourth length along the second longitudinal axis, and a fourth width; and the fourth width may be substantially smaller than the second width.

In some examples, the lighting system may further have an array of a plurality of lighting modules being mounted in the first enclosure, the pivotable joint assembly may be configured for permitting a one of the first spaced-apart pair of elongated side panels to face towards a one of the third spaced-apart pair of elongated side panels, and the first enclosure may be configured for mounting the array of the plurality of lighting modules for emitting light emissions through another one of the first spaced-apart pair of elongated side panels.

In further examples of the lighting system, the another one of the first spaced-apart pair of elongated side panels may include a first transparent panel region having a generally flat profile.

In additional examples of the lighting system, each one of the plurality of the lighting modules may include a semiconductor light-emitting device.

In other examples of the lighting system, each one of the plurality of the lighting modules may have a central light emission axis, and each one of the plurality of the lighting modules may be configured for emitting light emissions along the central light emission axis of the lighting module.

In some examples of the lighting system, the first enclosure may include a primary visible light reflector having a plurality of reflector apertures, the plurality of the reflector apertures being spaced apart along the first longitudinal axis and being aligned with the central light emission axes of the lighting modules.

In further examples of the lighting system, the primary visible light reflector may include the plurality of the reflector apertures as being spaced apart in a row along the first longitudinal axis.

In additional examples of the lighting system, the primary visible light reflector may include the plurality of the reflector apertures as being spaced apart in a plurality of rows along the first longitudinal axis.

In other examples of the lighting system, the primary visible light reflector may include a plurality of reflector elements, and each of the reflector elements may include a top reflective surface being located between two tangential reflective surfaces, and each of the reflector apertures of the primary visible light reflector may be located between a pair of the reflector elements.

In some examples of the lighting system, the first enclosure may further include a carrier having a plurality of carrier apertures, the plurality of the carrier apertures being spaced apart along the first longitudinal axis and being aligned with the central light emission axes of the lighting modules, each one of the plurality of the carrier apertures of the carrier being configured and shaped for receiving and mounting a lens module.

In further examples, the lighting system may further include an array of a plurality of lighting modules being mounted in the first enclosure, the pivotable joint assembly may be configured for permitting a one of the first spaced-apart pair of elongated side panels to face towards a one of the third spaced-apart pair of elongated side panels, and the first enclosure may be configured for mounting the array of the plurality of lighting modules for emitting light emissions through a one of the second spaced-apart pair of elongated side panels.

In other examples of the lighting system, the pivotable joint assembly may include a first pivot joint element being attached to the first enclosure and a second pivot joint element being attached to the second enclosure, and the first and second pivot joint elements may be configured for cooperatively securing the one of the first spaced-apart pair of elongated side panels at a position being located away from the one of the third spaced-apart pair of elongated side panels around the pivotable joint axis by an angle being within the range of between about 0 degrees and about 180 degrees.

In some examples of the lighting system, the pivotable joint assembly may include a first pivot joint element being attached to the first enclosure and a second pivot joint element being attached to the second enclosure, and the first and second pivot joint elements may be configured for cooperatively securing the one of the first spaced-apart pair of elongated side panels at a position being located away from the one of the third spaced-apart pair of elongated side panels by an angle around the pivotable joint axis.

In further examples of the lighting system, the first pivot joint element may include a first circular disc having a first flat side with raised features, and the second pivot joint element may include a second circular disc having a second flat side with raised features, and the pivotable joint assembly may be configured for placing the first flat side of the first circular disc in direct contact with the second flat side of the second circular disc.

In other examples of the lighting system, the raised features of the first and second flat sides of the first and second circular discs may each include a circular pattern of alternating radially extending crests and valleys having a uniform contour.

In some examples of the lighting system, the pivotable joint assembly may include a spring being configured for biasing the first flat side of the first circular disc as being in direct contact with the second flat side of the second circular disc.

In further examples of the lighting system, the first pivot joint element may include a first circular clutch plate, and the second pivot joint element may include a second circular clutch plate, and the pivotable joint assembly may be configured for placing the first clutch plate in direct contact with the second clutch plate.

In additional examples of the lighting system, the first clutch plate may include a first frictional pad, and the second clutch plate may include a second frictional pad, and the pivotable joint assembly may be configured for placing the first frictional pad in direct contact with the second frictional pad.

In other examples, the lighting system may include another pivotable joint assembly that may include a third pivot joint element being attached to the first enclosure and a fourth pivot joint element being attached to the second enclosure, and the third and fourth pivot joint elements may be configured for cooperatively securing the one of the first spaced-apart pair of elongated side panels at a position being located away from the one of the third spaced-apart pair of elongated side panels around the pivotable joint axis by an angle within the range of between about 0 degrees and about 180 degrees.

In some examples, the lighting system may include another pivotable joint assembly that may include a third pivot joint element being attached to the first enclosure and a fourth pivot joint element being attached to the second enclosure, and the third and fourth pivot joint elements may be configured for cooperatively securing the one of the first spaced-apart pair of elongated side panels at a position being located away from the one of the third spaced-apart pair of elongated side panels by an angle around the pivotable joint axis.

In further examples of the lighting system, the third pivot joint element may include a third circular disc having a third flat side with raised features, and the fourth pivot joint element may include a fourth circular disc having a fourth flat side with raised features, and the another pivotable joint assembly may be configured for placing the third flat side of the third circular disc in direct contact with the fourth flat side of the fourth circular disc.

In additional examples of the lighting system, the raised features of the third and fourth flat sides of the third and fourth circular discs may each include a circular pattern of alternating radially extending crests and valleys having a uniform contour.

In other examples of the lighting system, the another pivotable joint assembly may include another spring being configured for biasing the third flat side of the third circular disc as being in direct contact with the fourth flat side of the fourth circular disc.

In some examples of the lighting system, the second pivot joint element may be attached to one of the end panels of the second enclosure, and the fourth pivot joint element may be attached to another one of the end panels of the second enclosure.

In further examples of the lighting system, each of the first and third pivot joint elements may be attached to the one of the first spaced-apart pair of elongated side panels.

In additional examples of the lighting system, the one of the first spaced-apart pair of elongated side panels may include: a support plate attached to the pivotable joint assembly; and another support plate attached to the another pivotable joint assembly.

In other examples of the lighting system, each of the support plates may include a raised rib being spaced apart from a raised lip, being configured for attaching the support plates to the one of the first spaced-apart pair of elongated side panels; and the one of the first spaced-apart pair of elongated side panels may include two spaced-apart tracks configured for receiving the raised ribs and the raised lips.

In some examples of the lighting system, each of the pivot joint elements may include a raised rib being spaced apart from a raised lip, being configured for attaching the pivot joint elements to the one of the first spaced-apart pair of elongated side panels.

In further examples of the lighting system, the second enclosure may be configured for mounting the lighting system by placing a one of the third spaced-apart pair of elongated side panels in contact with a support.

In additional examples of the lighting system, the second enclosure may include a mounting hole in the one of the third spaced-apart pair of elongated side panels, and the mounting hole may be adapted for receiving a screw or nail for placing the second enclosure in contact with a support.

In further examples of the lighting system, the second enclosure may include a plurality of mounting holes in the one of the third spaced-apart pair of elongated side panels, and each of the mounting holes may be adapted for receiving a screw or nail for placing the second enclosure in contact with a support.

Other systems, processes, features and advantages of the invention will be or will become apparent to one with skill in the art upon examination of the following figures and detailed description. It is intended that all such additional systems, processes, features and advantages be included within this description, be within the scope of the invention, and be protected by the accompanying claims.

BRIEF DESCRIPTION OF THE FIGURES

The invention can be better understood with reference to the following figures. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
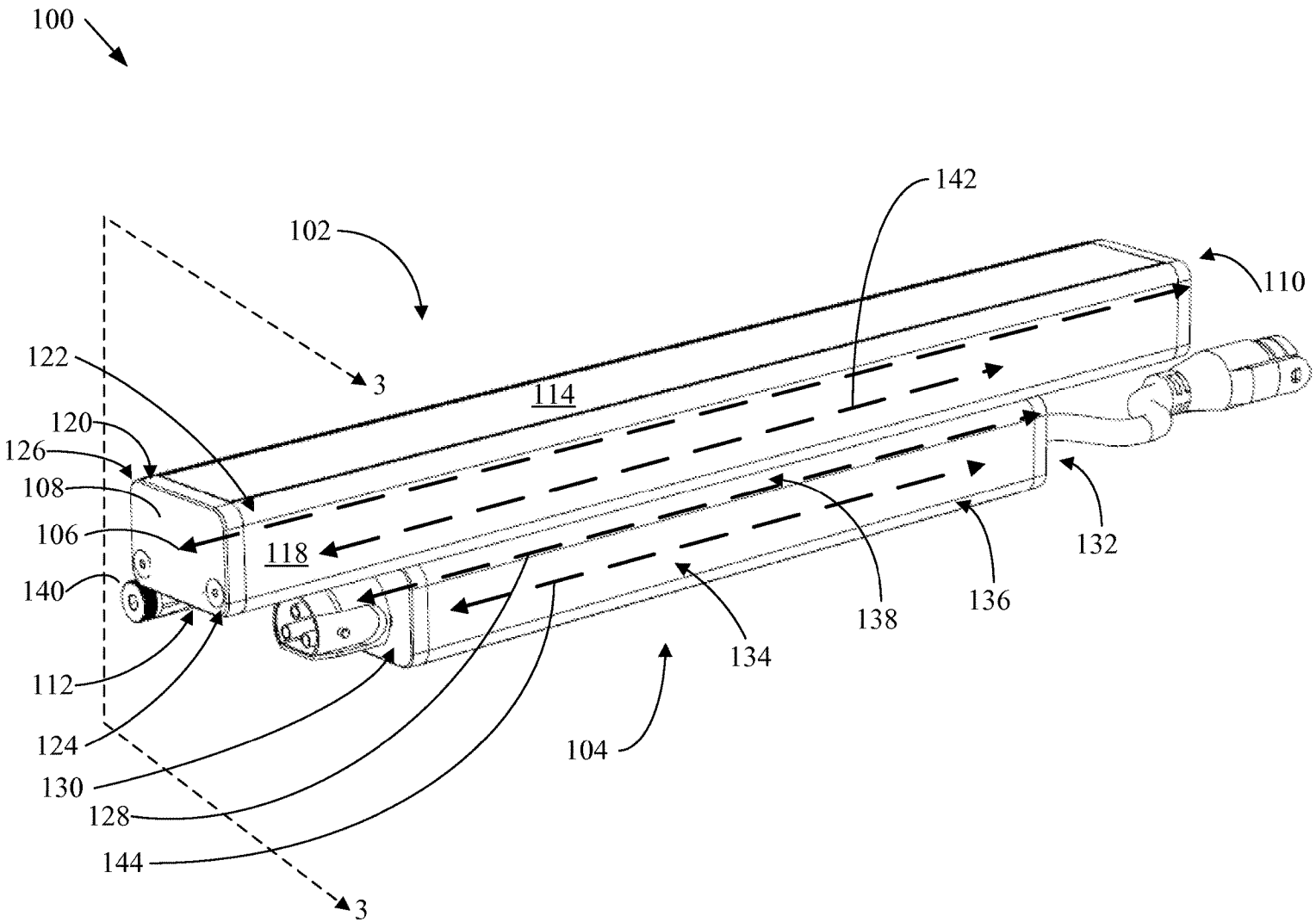
FIG. 1 is a perspective view showing an example [100] of an implementation of a lighting system.

Various lighting systems that utilize semiconductor light-emitting devices have been designed. Many such lighting systems exist that may include an array of lighting modules. However, existing lighting systems often provide limited flexibility for mounting the lighting systems, and fail to enable the orientations for the light emissions to be easily and repeatedly selected and changed from among a wide range of options.

Lighting systems accordingly are provided herein, that include: a first enclosure; a second enclosure; and a pivotable joint assembly. The first enclosure is elongated along a first longitudinal axis and is configured for mounting an array of a plurality of lighting modules. The first enclosure includes: two opposing end panels being spaced apart along the first longitudinal axis; a first spaced-apart pair of opposing elongated side panels; a second spaced-apart pair of opposing elongated side panels; and four elongated enclosure edges joining together the first and second pairs of the elongated side panels along the first longitudinal axis. The second enclosure is elongated along a second longitudinal axis and is configured for containing a lighting module power supply. The second enclosure includes: two additional opposing end panels being spaced apart along the second longitudinal axis; a third spaced-apart pair of opposing elongated side panels; a fourth spaced-apart pair of opposing elongated side panels; and four additional elongated enclosure edges joining together the third and fourth pairs of the elongated side panels along the second longitudinal axis. The pivotable joint assembly has a pivotable joint axis; and the pivotable joint axis is parallel with the first and second longitudinal axes. The pivotable joint assembly is interposed between a one of the elongated enclosure edges and a one of the additional elongated enclosure edges. The pivotable joint assembly is configured for constraining movement of the first longitudinal axis relative to the second longitudinal axis as being around and parallel with the pivotable joint axis.

The following definitions of terms, being stated as applying "throughout this specification", are hereby deemed to be incorporated throughout this specification, including but not limited to the Summary, Brief Description of the Figures, Detailed Description, and Claims.

Throughout this specification, the term "semiconductor" means: a substance, examples including a solid chemical element or compound, that can conduct electricity under some conditions but not others, making the substance a good medium for the control of electrical current.

Throughout this specification, the term "semiconductor light-emitting device" (also being abbreviated as "SLED") means: a light-emitting diode; an organic light-emitting diode; a laser diode; or any other light-emitting device having one or more layers containing inorganic and/or organic semiconductor(s). Throughout this specification, the term "light-emitting diode" (herein also referred to as an "LED") means: a two-lead semiconductor light source having an active pn-junction. As examples, an LED may include a series of semiconductor layers that may be epitaxially grown on a substrate such as, for example, a substrate that includes sapphire, silicon, silicon carbide, gallium nitride or gallium arsenide. Further, for example, one or more semiconductor p-n junctions may be formed in these epitaxial layers. When a sufficient voltage is applied across the p-n junction, for example, electrons in the n-type semiconductor layers and holes in the p-type semiconductor layers may flow toward the p-n junction. As the electrons and holes flow toward each other, some of the electrons may recombine with corresponding holes, and emit photons. The energy release is called electroluminescence, and the color of the light, which corresponds to the energy of the photons, is determined by the energy band gap of the semiconductor. As examples, a spectral power distribution of the light generated by an LED may generally depend on the particular semiconductor materials used and on the structure of the thin epitaxial layers that make up the "active panel region" of the device, being the area where the light is generated. As examples, an LED may have a light-emissive electroluminescent layer including an inorganic semiconductor, such as a Group III-V semiconductor, examples including: gallium nitride; silicon; silicon carbide; and zinc oxide. Throughout this specification, the term "organic light-emitting diode" (herein also referred to as an "OLED") means: an LED having a light-emissive electroluminescent layer including an organic semiconductor, such as small organic molecules or an organic polymer. It is understood throughout this specification that a semiconductor light-emitting device may include: a non-semiconductor-substrate or a semiconductor-substrate; and may include one or more electrically-conductive contact layers. Further, it is understood throughout this specification that an LED may include a substrate formed of materials such as, for example: silicon carbide; sapphire; gallium nitride; or silicon. It is additionally understood throughout this specification that a semiconductor light-emitting device may have a cathode contact on one side and an anode contact on an opposite side, or may alternatively have both contacts on the same side of the device.

Further background information regarding semiconductor light-emitting devices is provided in the following documents, the entireties of all of which hereby are incorporated by reference herein: U.S. Pat. Nos. 7,564,180; 7,456,499; 7,213,940; 7,095,056; 6,958,497; 6,853,010; 6,791,119; 6,600,175; 6,201,262; 6,187,606; 6,120,600; 5,912,477; 5,739,554; 5,631,190; 5,604,135; 5,523,589; 5,416,342; 5,393,993; 5,359,345; 5,338,944; 5,210,051; 5,027,168; 5,027,168; 4,966,862; and 4,918,497; and U.S. Patent Application Publication Nos. 2014/0225511; 2014/0078715; 2013/0241392; 2009/0184616; 2009/0080185; 2009/0050908; 2009/0050907; 2008/0308825; 2008/0198112; 2008/0179611; 2008/0173884; 2008/0121921; 2008/0012036; 2007/0253209; 2007/0223219; 2007/0170447; 2007/0158668; 2007/0139923; and 2006/0221272.

Throughout this specification, the term "spectral power distribution" means: the emission spectrum of the one or more wavelengths of light emitted by a semiconductor light-emitting device. Throughout this specification, the term "peak wavelength" means: the wavelength where the spectral power distribution of a semiconductor light-emitting device reaches its maximum value as detected by a photo-detector. As an example, an LED may be a source of nearly monochromatic light and may appear to emit light having a single color. Thus, the spectral power distribution of the light emitted by such an LED may be centered about its peak wavelength. As examples, the "width" of the spectral power distribution of an LED may be within a range of between about 10 nanometers and about 30 nanometers, where the width is measured at half the maximum illumination on each side of the emission spectrum. Throughout this specification, the term "full-width-half-maximum" ("FWHM") means: the full width of the spectral power distribution of a semiconductor light-emitting device measured at half the maximum illumination on each side of its emission spectrum. Throughout this specification, the term "half-width-half-maximum" ("HWHM") means: half of the full width of a FWHM. Throughout this specification, the term "dominant wavelength" means: the wavelength of monochromatic light that has the same apparent color as the light emitted by a semiconductor light-emitting device, as perceived by the human eye. As an example, since the human eye perceives yellow and green light better than red and blue light, and because the light emitted by a semiconductor light-emitting device may extend across a range of wavelengths, the color perceived (i.e., the dominant wavelength) may differ from the peak wavelength.

Throughout this specification, the term "luminous flux", also referred to as "luminous power", means: the measure in lumens of the perceived power of light, being adjusted to reflect the varying sensitivity of the human eye to different wavelengths of light. Throughout this specification, the term "radiant flux" means: the measure of the total power of electromagnetic radiation without being so adjusted. Throughout this specification, the term "central light emission axis" means a direction along which the light emissions of a semiconductor light-emitting device have a greatest radiant flux. It is understood throughout this specification that light emissions "along a central light emission axis" means light emissions that: include light emissions in the directions of the central light emission axis; and may further include light emissions in a plurality of other generally similar directions.

It is understood throughout this specification that the word "along" generally means "in directions that include the same directions as, and also in other directions being similar to". It is understood throughout this specification that light emissions "along the longitudinal axis" means light emissions that: include light emissions in the directions of the longitudinal axis; and may further include light emissions in a plurality of other generally similar directions. It is understood throughout this specification that light emissions "in directions transverse to the longitudinal axis" means light emissions that: include light emissions in the directions being orthogonal to the longitudinal axis; and may further include light emissions in a plurality of other generally similar directions. It is understood throughout this specification that light emissions "in directions spaced apart from directions along the longitudinal axis" means light emissions in directions being similar to and spaced apart from the directions along the longitudinal axis. It is understood throughout this specification that light emissions "in directions spaced apart from directions transverse to the longitudinal axis" means light emissions in directions being similar to and spaced apart from the directions being transverse to the longitudinal axis.

Throughout this specification, the term "luminescent" means: characterized by absorption of electromagnetic radiation (e.g., visible light, UV light or infrared light) causing the emission of light by, as examples: fluorescence; and phosphorescence.

Throughout this specification, the term "object" means a material article or device. Throughout this specification, the term "surface" means an exterior boundary of an object. Throughout this specification, the term "incident visible light" means visible light that propagates in one or more directions towards a surface. Throughout this specification, the term "reflective surface" means a surface of an object that causes incident visible light, upon reaching the surface, to then propagate in one or more different directions away from the surface without passing through the object. Throughout this specification, the term "planar reflective surface" means a generally flat reflective surface.

Throughout this specification, the term "reflectance" means a fraction of a radiant flux of incident visible light having a specified wavelength that is caused by a reflective surface of an object to propagate in one or more different directions away from the surface without passing through the object. Throughout this specification, the term "reflected light" means the incident visible light that is caused by a reflective surface to propagate in one or more different directions away from the surface without passing through the object. Throughout this specification, the term "Lambertian reflectance" means diffuse reflectance of visible light from a surface, in which the reflected light has uniform radiant flux in all of the propagation directions. Throughout this specification, the term "specular reflectance" means mirror-like reflection of visible light from a surface, in which light from a single incident direction is reflected into a single propagation direction. Throughout this specification, the term "spectrum of reflectance values" means a spectrum of values of fractions of radiant flux of incident visible light, the values corresponding to a spectrum of wavelength values of visible light, that are caused by a reflective surface to propagate in one or more different directions away from the surface without passing through the object. Throughout this specification, the term "transmittance" means a fraction of a radiant flux of incident visible light having a specified wavelength that is permitted by a reflective surface to pass through the object having the reflective surface. Throughout this specification, the term "transmitted light" means the incident visible light that is permitted by a reflective surface to pass through the object having the reflective surface. Throughout this specification, the term "spectrum of transmittance values" means a spectrum of values of fractions of radiant flux of incident visible light, the values corresponding to a spectrum of wavelength values of visible light, that are permitted by a reflective surface to pass through the object having the reflective surface. Throughout this specification, the term "absorbance" means a fraction of a radiant flux of incident visible light having a specified wavelength that is permitted by a reflective surface to pass through the reflective surface and is absorbed by the object having the reflective surface. Throughout this specification, the term "spectrum of absorbance values" means a spectrum of values of fractions of radiant flux of incident visible light, the values corresponding to a spectrum of wavelength values of visible light, that are permitted by a reflective surface to pass through the reflective surface and are absorbed by the object having the reflective surface. Throughout this specification, it is understood that a reflective surface, or an object, may have a spectrum of reflectance values, and a spectrum of transmittance values, and a spectrum of absorbance values. The spectra of reflectance values, absorbance values, and transmittance values of a reflective surface or of an object may be measured, for example, utilizing an ultraviolet-visible-near infrared (UV-VIS-NIR) spectrophotometer. Throughout this specification, the term "visible light reflector" means an object having a reflective surface. In examples, a visible light reflector may be selected as having a reflective surface characterized by light reflections that are more Lambertian than specular.

Throughout this specification, the term "lumiphor" means: a medium that includes one or more luminescent materials being positioned to absorb light that is emitted at a first spectral power distribution by a semiconductor light-emitting device, and to re-emit light at a second spectral power distribution in the visible or ultra violet spectrum being different than the first spectral power distribution, regardless of the delay between absorption and re-emission. Lumiphors may be categorized as being down-converting, i.e., a material that converts photons to a lower energy level (longer wavelength); or up-converting, i.e., a material that converts photons to a higher energy level (shorter wavelength). As examples, a luminescent material may include: a phosphor; a quantum dot; a quantum wire; a quantum well; a photonic nanocrystal; a semiconducting nanoparticle; a scintillator; a lumiphoric ink; a lumiphoric organic dye; a day glow tape; a phosphorescent material; or a fluorescent material. Throughout this specification, the term "quantum material" means any luminescent material that includes: a quantum dot; a quantum wire; or a quantum well. Some quantum materials may absorb and emit light at spectral power distributions having narrow wavelength ranges, for example, wavelength ranges having spectral widths being within ranges of between about 25 nanometers and about 50 nanometers. In examples, two or more different quantum materials may be included in a lumiphor, such that each of the quantum materials may have a spectral power distribution for light emissions that may not overlap with a spectral power distribution for light absorption of any of the one or more other quantum materials. In these examples, cross-absorption of light emissions among the quantum materials of the lumiphor may be minimized. As examples, a lumiphor may include one or more layers or bodies that may contain one or more luminescent materials that each may be: (1) coated or sprayed directly onto an semiconductor light-emitting device; (2) coated or sprayed onto surfaces of a lens or other elements of packaging for an semiconductor light-emitting device; (3) dispersed in a matrix medium; or (4) included within a clear encapsulant (e.g., an epoxy-based or silicone-based curable resin or glass or ceramic) that may be positioned on or over an semiconductor light-emitting device. A lumiphor may include one or multiple types of luminescent materials. Other materials may also be included with a lumiphor such as, for example, fillers, diffusants, colorants, or other materials that may as examples improve the performance of or reduce the overall cost of the lumiphor. In examples where multiple types of luminescent materials may be included in a lumiphor, such materials may, as examples, be mixed together in a single layer or deposited sequentially in successive layers.

Throughout this specification, the term "volumetric lumiphor" means a lumiphor being distributed in an object having a shape including defined exterior surfaces. In some examples, a volumetric lumiphor may be formed by dispersing a lumiphor in a volume of a matrix medium having suitable spectra of visible light transmittance values and visible light absorbance values. As examples, such spectra may be affected by a thickness of the volume of the matrix medium, and by a concentration of the lumiphor being distributed in the volume of the matrix medium. In examples, the matrix medium may have a composition that includes polymers or oligomers of: a polycarbonate; a silicone; an acrylic; a glass; a polystyrene; or a polyester such as polyethylene terephthalate. Throughout this specification, the term "remotely-located lumiphor" means a lumiphor being spaced apart at a distance from and positioned to receive light that is emitted by a semiconductor light-emitting device.

Throughout this specification, the term "light-scattering particles" means small particles formed of a non-luminescent, non-wavelength-converting material. In some examples, a volumetric lumiphor may include light-scattering particles being dispersed in the volume of the matrix medium for causing some of the light emissions having the first spectral power distribution to be scattered within the volumetric lumiphor. As an example, causing some of the light emissions to be so scattered within the matrix medium may cause the luminescent materials in the volumetric lumiphor to absorb more of the light emissions having the first spectral power distribution. In examples, the light-scattering particles may include: rutile titanium dioxide; anatase titanium dioxide; barium sulfate; diamond; alumina; magnesium oxide; calcium titanate; barium titanate; strontium titanate; or barium strontium titanate. In examples, light-scattering particles may have particle sizes being within a range of about 0.01 micron (10 nanometers) and about 2.0 microns (2,000 nanometers).

In some examples, a visible light reflector may be formed by dispersing light-scattering particles having a first index of refraction in a volume of a matrix medium having a second index of refraction being suitably different from the first index of refraction for causing the volume of the matrix medium with the dispersed light-scattering particles to have suitable spectra of reflectance values, transmittance values, and absorbance values for functioning as a visible light reflector. As examples, such spectra may be affected by a thickness of the volume of the matrix medium, and by a concentration of the light-scattering particles being distributed in the volume of the matrix medium, and by physical characteristics of the light-scattering particles such as the particle sizes and shapes, and smoothness or roughness of exterior surfaces of the particles. In an example, the smaller the difference between the first and second indices of refraction, the more light-scattering particles may need to be dispersed in the volume of the matrix medium to achieve a given amount of light-scattering. As examples, the matrix medium for forming a visible light reflector may have a composition that includes polymers or oligomers of: a polycarbonate; a silicone; an acrylic; a glass; a polystyrene; or a polyester such as polyethylene terephthalate. In further examples, the light-scattering particles may include: rutile titanium dioxide; anatase titanium dioxide; barium sulfate; diamond; alumina; magnesium oxide; calcium titanate; barium titanate; strontium titanate; or barium strontium titanate. In other examples, a visible light reflector may include a reflective polymeric or metallized surface formed on a visible light-transmissive polymeric or metallic object such as, for example, a volume of a matrix medium. Additional examples of visible light reflectors may include microcellular foamed polyethylene terephthalate sheets ("MCPET"). Suitable visible light reflectors may be commercially available under the trade names White Optics® and MIRO® from WhiteOptics LLC, 243-G Quigley Blvd., New Castle, Del. 19720 USA. Suitable MCPET visible light reflectors may be commercially available from the Furukawa Electric Co., Ltd., Foamed Products Division, Tokyo, Japan. Additional suitable visible light reflectors may be commercially available from CVI Laser Optics, 200 Dorado Place SE, Albuquerque, N. Mex. 87123 USA.

In some examples, a converging or diverging lens may be formed as a volume of a matrix medium having a suitable shape for functioning as a lens. In further examples, forming a diverging lens may include dispersing light-scattering particles having a first index of refraction in a volume of a matrix medium having a second index of refraction being suitably different from the first index of refraction for causing the volume of the matrix medium with the dispersed light-scattering particles to have suitable light-scattering value for functioning as a diverging lens. As examples, the matrix medium for forming a lens may have a composition that includes polymers or oligomers of: a polycarbonate; a silicone; an acrylic; a glass; a polystyrene; or a polyester such as polyethylene terephthalate. In further examples, the light-scattering particles may include: rutile titanium dioxide; anatase titanium dioxide; barium sulfate; diamond; alumina; magnesium oxide; calcium titanate; barium titanate; strontium titanate; or barium strontium titanate.

In further examples, a volumetric lumiphor and a visible light reflector may be integrally formed. As examples, a volumetric lumiphor and a visible light reflector may be integrally formed in respective layers of a volume of a matrix medium, including a layer of the matrix medium having a dispersed lumiphor, and including another layer of the same or a different matrix medium having light-scattering particles being suitably dispersed for causing the another layer to have suitable spectra of reflectance values, transmittance values, and absorbance values for functioning as the visible light reflector. In other examples, an integrally-formed volumetric lumiphor and visible light reflector may incorporate any of the further examples of variations discussed above as to separately-formed volumetric lumiphors and visible light reflectors.

Throughout this specification, the term "phosphor" means: a material that exhibits luminescence when struck by photons. Examples of phosphors that may be utilized include: $CaAlSiN_3$:Eu, $SrAlSiN_3$:Eu, $CaAlSiN_3$:Eu, $Ba_3Si_6O_{12}N_2$:Eu, $Ba_2SiO_4$:Eu, $Sr_2SiO_4$:Eu, $Ca_2SiO_4$:Eu, $Ca_3Sc_2Si_3O_{12}$:Ce, $Ca_3Mg_2Si_3O_{12}$:Ce, $CaSc_2O_4$:Ce, $CaSi_2O_2N_2$:Eu, $SrSi_2O_2N_2$:Eu, $BaSi_2O_2N_2$:Eu, $Ca_5(PO_4)_3$ Cl:Eu, $Ba_5(PO_4)_3$Cl:Eu, $Cs_2CaP_2O_7$, $Cs_2SrP_2O_7$, $SrGa_2S_4$: Eu, $Lu_3Al_5O_{12}$:Ce, $Ca_8Mg(SiO_4)_4Cl_2$:Eu, $Sr_8Mg(SiO_4)_4$ $Cl_2$:Eu, $La_3Si_6N_1$:Ce, $Y_3Al_5O_{12}$:Ce, $Y_3Ga_5O_{12}$:Ce, $Gd_3Al_5O_{12}$:Ce, $Gd_3Ga_5O_{12}$:Ce, $Tb_3Al_5O_{12}$:Ce, $Tb_3Ga_5O_{12}$: Ce, $Lu_3Ga_5O_{12}$:Ce, (SrCa)$AlSiN_3$:Eu, LuAG:Ce, $(Y,Gd)_2$ $Al_5)_{12}$:Ce, CaS:Eu, SrS:Eu, $SrGa_2S_4$:$E_4$, $Ca_2(Sc,Mg)_2$ $SiO_{12}$:Ce, $Ca_2Sc_2Si_2)_{12}$:C2, $Ca_2Sc_2O_4$:Ce, $Ba_2Si_6O_{12}N_2$: Eu, (Sr,Ca)$AlSiN_2$:Eu, and $CaAlSiN_2$:Eu.

Throughout this specification, the term "quantum dot" means: a nanocrystal made of semiconductor materials that are small enough to exhibit quantum mechanical properties, such that its excitons are confined in all three spatial dimensions.

Throughout this specification, the term "quantum wire" means: an electrically conducting wire in which quantum effects influence the transport properties.

Throughout this specification, the term "quantum well" means: a thin layer that can confine (quasi-)particles (typically electrons or holes) in the dimension perpendicular to the layer surface, whereas the movement in the other dimensions is not restricted.

Throughout this specification, the term "photonic nanocrystal" means: a periodic optical nanostructure that affects the motion of photons, for one, two, or three dimensions, in much the same way that ionic lattices affect electrons in solids.

Throughout this specification, the term "semiconducting nanoparticle" means: a particle having a dimension within a range of between about 1 nanometer and about 100 nanometers, being formed of a semiconductor.

Throughout this specification, the term "scintillator" means: a material that fluoresces when struck by photons.

Throughout this specification, the term "lumiphoric ink" means: a liquid composition containing a luminescent material. For example, a lumiphoric ink composition may contain semiconductor nanoparticles. Examples of lumiphoric ink compositions that may be utilized are disclosed in Cao et al., U.S. Patent Application Publication No. 20130221489 published on Aug. 29, 2013, the entirety of which hereby is incorporated herein by reference.

Throughout this specification, the term "lumiphoric organic dye" means an organic dye having luminescent up-converting or down-converting activity. As au example, some perylene-based dyes may be suitable.

Throughout this specification, the term "day glow tape" means: a tape material containing a luminescent material.

Throughout this specification, the term "visible light" means light having one or more wavelengths being within a range of between about 380 nanometers and about 670 nanometers; and "visible light spectrum" means the range of wavelengths of between about 380 nanometers and about 670 nanometers.

Throughout this specification, the term "white light" means: light having a color point located at a delta(uv) of about equal to or less than 0.006 and having a CCT being within a range of between about 10000K and about 1800K (herein referred to as a "white color point."). Many different hues of light may be perceived as being "white." For example, some "white" light, such as light generated by a tungsten filament incandescent lighting device, may appear yellowish in color, while other "white" light, such as light generated by some fluorescent lighting devices, may appear more bluish in color. As examples, white light having a CCT of about 3000K may appear yellowish in color, while white light having a CCT of about equal to or greater than 8000K may appear more bluish in color and may be referred to as "cool" white light. Further, white light having a CCT of between about 2500K and about 4500K may appear reddish or yellowish in color and may be referred to as "warm" white light. "White light" includes light having a spectral power distribution of wavelengths including red, green and blue color points. In an example, a CCT of a lumiphor may be tuned by selecting one or more particular luminescent materials to be included in the lumiphor. For example, light emissions from a semiconductor light-emitting device that includes three separate emitters respectively having red, green and blue color points with an appropriate spectral power distribution may have a white color point. As another example, light perceived as being "white" may be produced by mixing light emissions from a semiconductor light-emitting device having a blue, greenish-blue or purplish-blue color point together with light emissions having a yellow color point being produced by passing some of the light emissions having the blue, greenish-blue or purplish-blue color point through a lumiphor to down-convert them into light emissions having the yellow color point. General background information on systems and processes for generating light perceived as being "white" is provided in "Class A Color Designation for Light Sources Used in General Illumination", Freyssinier and Rea, *J. Light & Vis. Env.*, Vol. 37, No. 2 & 3 (Nov. 7, 2013, Illuminating Engineering Institute of Japan), pp. 10-14; the entirety of which hereby is incorporated herein by reference.

Throughout this specification, the term "in contact with" means: that a first object, being "in contact with" a second object, is in either direct or indirect contact with the second object. Throughout this specification, the term "in indirect contact with" means: that the first object is not in direct contact with the second object, but instead that there are a plurality of objects (including the first and second objects), and each of the plurality of objects is in direct contact with at least one other of the plurality of objects (e.g., the first and second objects are in a stack and are separated by one or more intervening layers). Throughout this specification, the term "in direct contact with" means: that the first object, which is "in direct contact" with a second object, is touching the second object and there are no intervening objects between at least portions of both the first and second objects.

Throughout this specification, the term "spectrophotometer" means: an apparatus that can measure a light beam's intensity as a function of its wavelength and calculate its total luminous flux.

Throughout this specification, the term "integrating sphere-spectrophotometer" means: a spectrophotometer operationally connected with an integrating sphere. An integrating sphere (also known as an Ulbricht sphere) is an optical component having a hollow spherical cavity with its interior covered with a diffuse white reflective coating, with small holes for entrance and exit ports. Its relevant property is a uniform scattering or diffusing effect. Light rays incident on any point on the inner surface are, by multiple scattering reflections, distributed equally to all other points. The effects of the original direction of light are minimized. An integrating sphere may be thought of as a diffuser which preserves power but destroys spatial information. Another type of integrating sphere that can be utilized is referred to as a focusing or Coblentz sphere. A Coblentz sphere has a mirror-like (specular) inner surface rather than a diffuse inner surface. Light scattered by the interior of an integrating sphere is evenly distributed over all angles. The total power (radiant flux) of a light source can then be measured without inaccuracy caused by the directional characteristics of the source. Background information on integrating sphere-spectrophotometer apparatus is provided in Liu et al., U.S. Pat. No. 7,532,324 issued on May 12, 2009, the entirety of which hereby is incorporated herein by reference. It is understood throughout this specification that color points may be measured, for example, by utilizing a spectrophotometer, such as an integrating sphere-spectrophotometer. The spectra of reflectance values, absorbance values, and transmittance values of a reflective surface or of an object may be measured, for example, utilizing an ultraviolet-visible-near infrared (UV-VIS-NIR) spectrophotometer.

Throughout this specification, the term "lenticular features" means: an array of semicircular convex lenses ("lenticles") on a surface, being arranged as a sinusoidal series of mutually parallel ridges between troughs, forming a series of "lenticular toroidal lenses." Background information on lenticular toroidal lenses and lenticular features is provided in Seo U.S. Pat. No. 8,503,083 issued on Aug. 6, 2013, the entirety of which hereby is incorporated herein by reference.

Throughout this specification, the term "microprismatic features" means an array of small, equally-spaced multifaceted prisms being arranged in a regular array forming a "microprismatic lens" on a surface. Background information on microprismatic lenses is provided in Pakhchyan U.S. Patent Application Publication No. 2011/0292483A1 published on Dec. 1, 2011, the entirety of which hereby is incorporated herein by reference.

It is understood throughout this specification that numbering of the names of elements as being "first", "second" etcetera, is solely for purposes of clarity in referring to such elements in connection with various examples of lighting systems. It is understood throughout this specification that an example [100] of a lighting system may include any combination of the features discussed in connection with the examples [100] of a lighting system.

Figure 2:
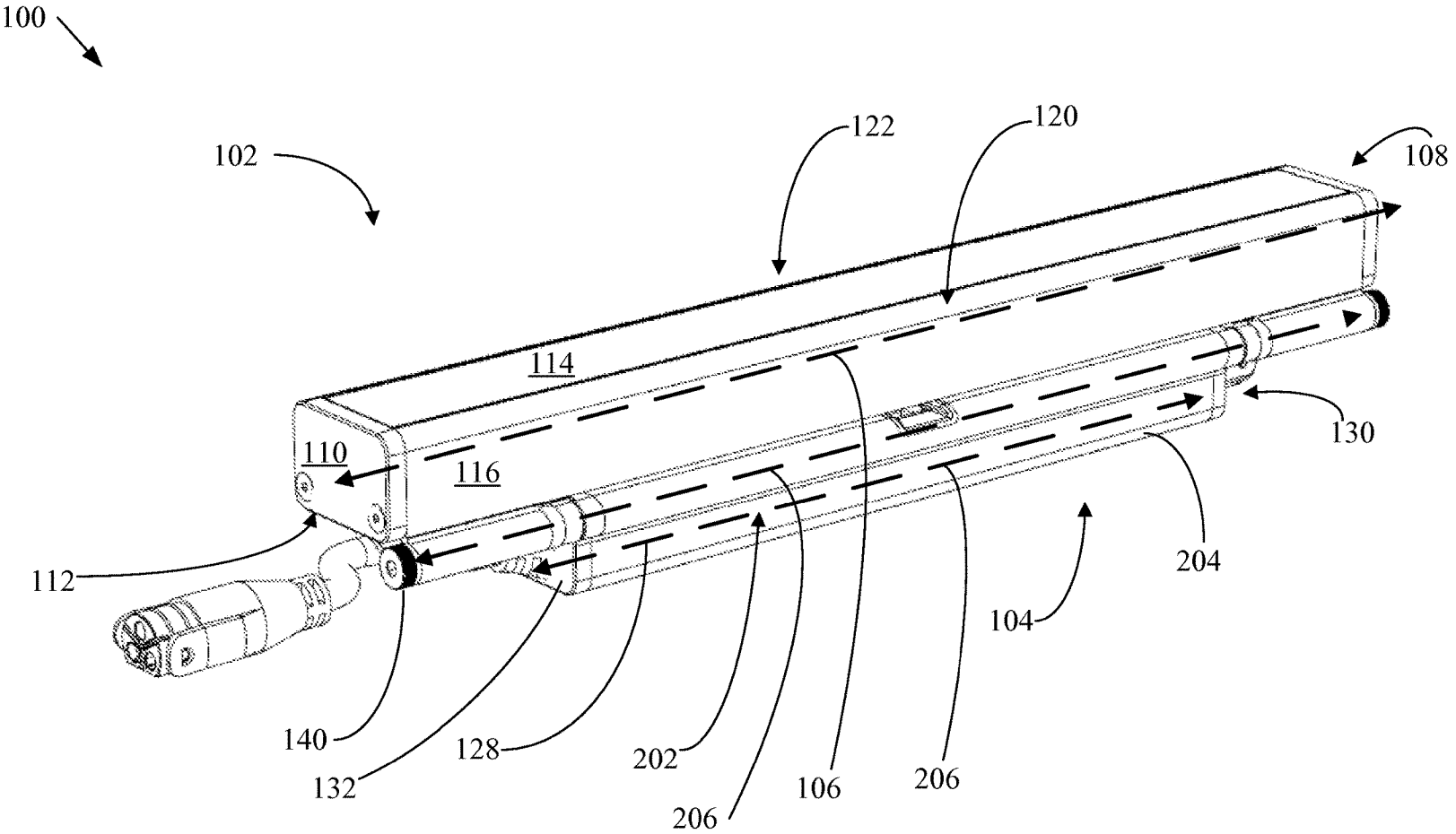
FIG. 2 is another perspective view showing the example [100] of an implementation of a lighting system.
Figure 3:
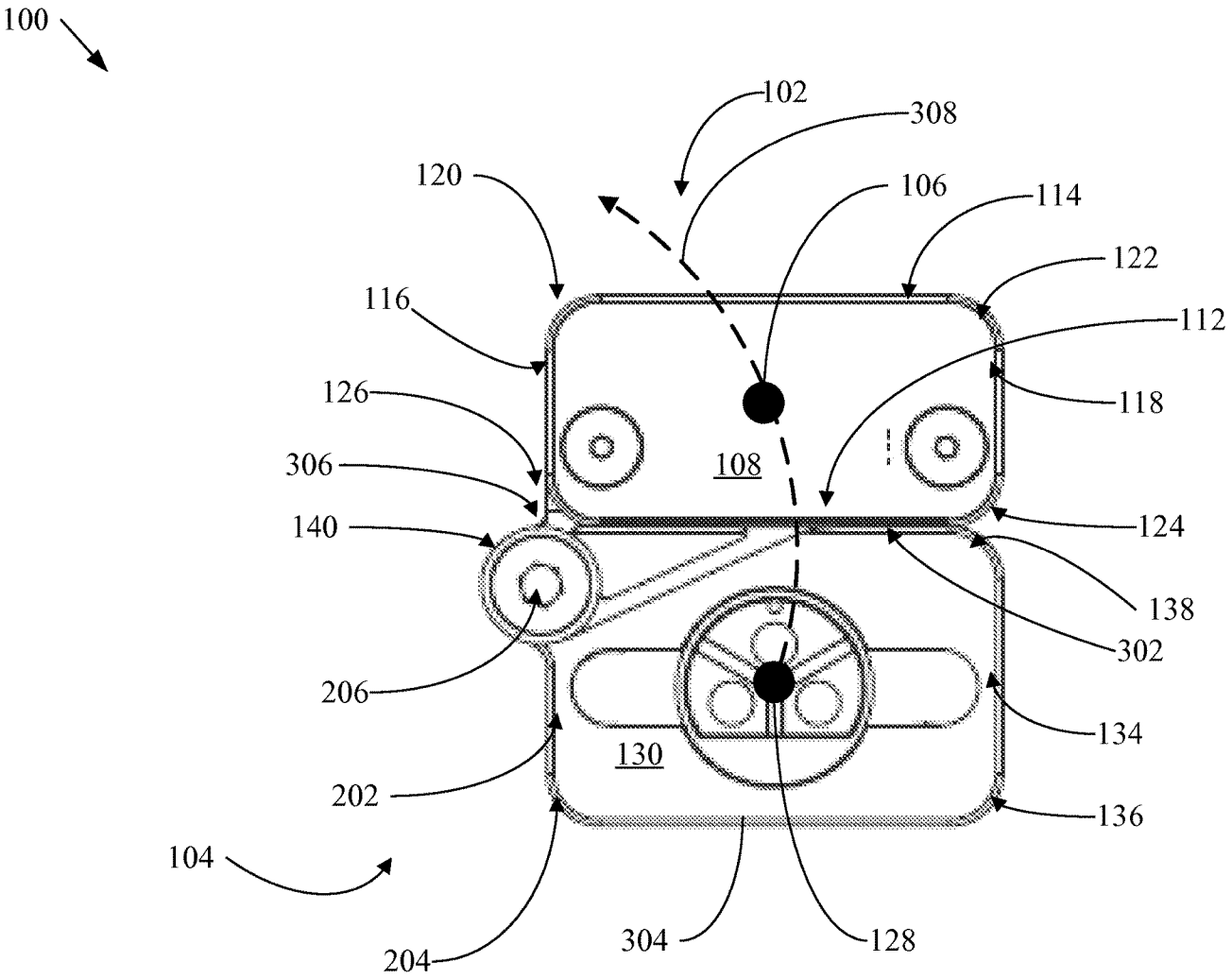
FIG. 3 is a side view taken along the line 3-3, showing the example [100] of the lighting system.
Figure 4:
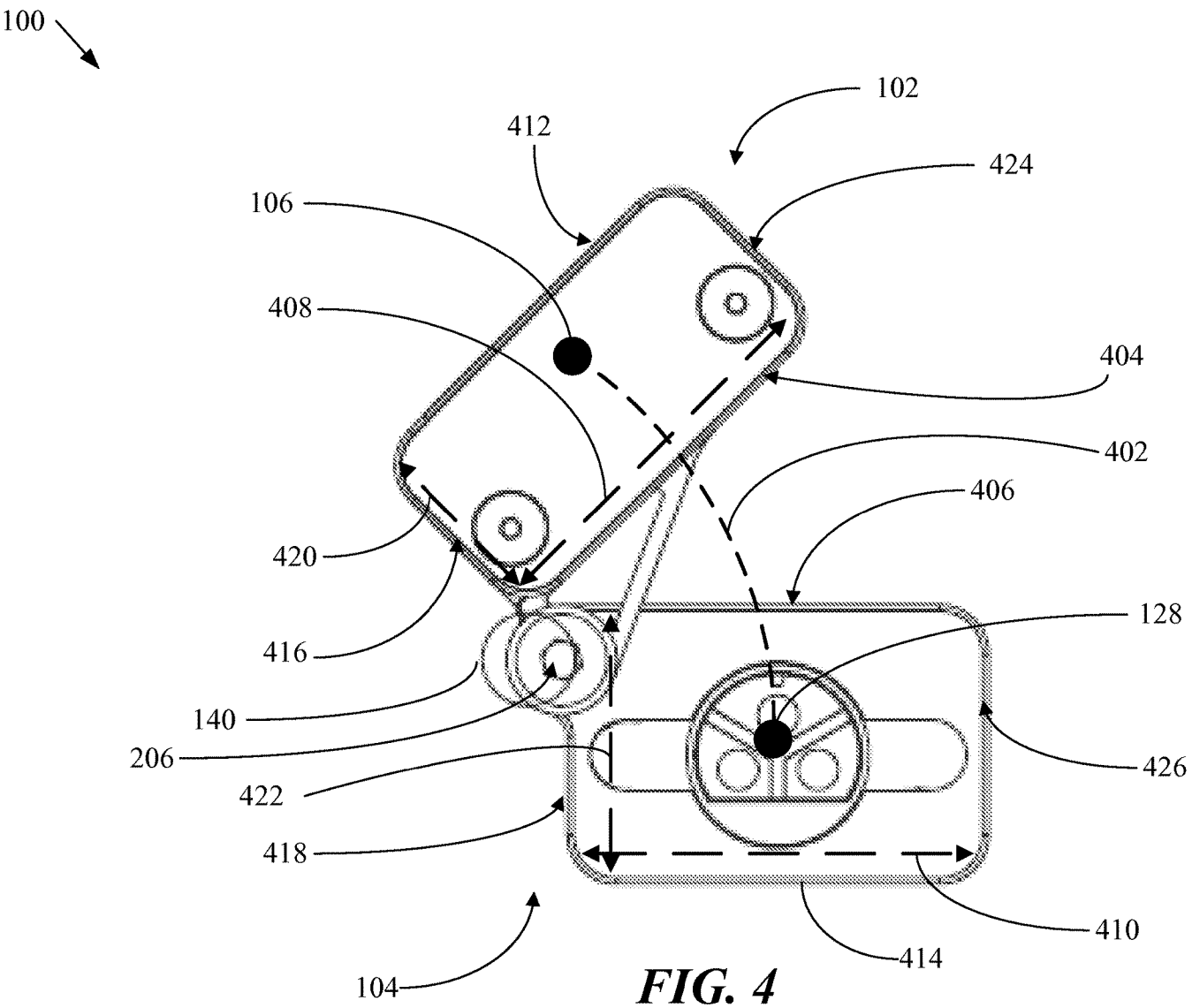
FIG. 4 is another side view of the example [100] of the lighting system shown in FIG. 3.

FIG. 1 is a perspective view showing an example [100] of an implementation of a lighting system. FIG. 2 is another perspective view showing the example [100] of an implementation of a lighting system. FIG. 3 is a side view taken along the line 3-3, showing the example [100] of the lighting system. FIG. 4 is another side view of the example [100] of the lighting system shown in FIG. 3. The example [100] of the lighting system includes a first enclosure [102] and a second enclosure [104]. The first enclosure [102] in the example [100] of the lighting system is elongated along a first longitudinal axis [106] and is configured for mounting an array (not shown) of a plurality of lighting modules. The first enclosure [102] of the example [100] of the lighting system includes two opposing end panels [108], [110] being spaced apart along the first longitudinal axis [106]. In the example [100] of the lighting system, the first enclosure [102] also includes a first spaced-apart pair of opposing elongated side panels [112], [114]. The first enclosure [102] of the example [100] of the lighting system further includes a second spaced-apart pair of opposing elongated side panels [116], [118]. In addition, the first enclosure [102] of the example [100] of the lighting system includes four elongated enclosure edges [120], [122], [124], [126] joining together the first pair of the elongated side panels [112], [114] and the second pair of the elongated side panels [116], [118] along the first longitudinal axis [106]. The second enclosure [104] in the example [100] of the lighting system is elongated along a second longitudinal axis [128]. The second enclosure [104] in the example [100] of the lighting system is configured for containing a lighting module power supply (not shown). The second enclosure [104] in the example [100] of the lighting system includes two additional opposing end panels [130], [132] being spaced apart along the second longitudinal axis [128]. The second enclosure [104] in the example [100] of the lighting system also includes a third spaced-apart pair of opposing elongated side panels [302], [304]. The second enclosure [104] in the example [100] of the lighting system further includes a fourth spaced-apart pair of opposing elongated side panels [134], [202]. In addition, the second enclosure [104] in the example [100] of the lighting system includes four additional elongated enclosure edges [136] [138], 204], [306] joining together the third pair of the elongated side panels [302], [304] and the fourth pair of the elongated side panels [134], [202] along the second longitudinal axis [128]. The example [100] of the lighting system additionally includes a pivotable joint assembly [140] having a pivotable joint axis [206]. In the example [100] of the lighting system, the pivotable joint axis [206] is parallel with the first longitudinal axis [106] and the second longitudinal axis [128]. Further, in the example [100] of the lighting system, the pivotable joint assembly [140] is interposed between a one of the elongated enclosure edges [126] and a one of the additional elongated enclosure edges [306]. Additionally, in the example [100] of the lighting system, the pivotable joint assembly [140] is configured for constraining movement of the first longitudinal axis [106] relative to the second longitudinal axis [128], being represented by an arrow [308], as being around and parallel with the pivotable joint axis [206].

FIG. 4 is another side view of an example [100] of the lighting system as shown in FIG. 3, with the first longitudinal axis [106] of the first enclosure [102] having been moved as represented by the arrow [402], away from the second longitudinal axis [128] of the second enclosure [104], partially around and parallel with the pivotable joint axis [206]. In some examples of the example [100] of the lighting system, the pivotable joint assembly [140] may be configured for permitting a one [112] of the first spaced-apart pair of elongated side panels [112], [114] to face towards a one [302] of the third spaced-apart pair of elongated side panels [302], [304]. In further examples of the example [100] of the lighting system, the pivotable joint assembly [140] may be configured for permitting a one [116] of the second spaced-apart pair of elongated side panels [116], [118] to face towards a one [202] of the fourth spaced-apart pair of elongated side panels [134], [202]. In additional examples of the example [100] of the lighting system, configuring the pivotable joint assembly [140] for permitting the one [116] of the second spaced-apart pair of elongated side panels [116], [118] to face towards the one [202] of the fourth spaced-apart pair of elongated side panels [134], [202] may include configuring the pivotable joint assembly [140] for permitting the one [112] of the first spaced-apart pair of elongated side panels [112], [114] to be rotated as represented by the arrow [402] away from the one [302] of the third spaced-apart pair of elongated side panels [302], [304] around the pivotable joint axis by an angle being within a range of between about 0 degrees and about 180 degrees.

In further examples of the example [100] of the lighting system, the one [112] of the first spaced-apart pair of elongated side panels [112], [114] may include a first panel region [404] having a generally flat profile, and the one [302] of the third spaced-apart pair of elongated side panels [302], [304] may include a third panel region [406] having a generally flat profile, and the pivotable joint assembly [140] may be configured for permitting the one [112] of the first spaced-apart pair of elongated side panels [112], [114] to be in direct contact with the one [302] of the third spaced-apart pair of elongated side panels [302], [304]. In other examples of the example [100] of the lighting system, the first panel region [404] may have first dimensions including a first length represented by an arrow [142] along the first longitudinal axis [106], and a first width [408]; and the third panel region [406] may have third dimensions including a third length represented by an arrow [144] along the second longitudinal axis [128], and a third width [410]; and the first width [408] may be substantially the same as the third width [410]. In some examples of the example [100] of the lighting system, another one [114] of the first spaced-apart pair of elongated side panels [112], [114] may include another first panel region [412] having a generally flat profile, and another one [304] of the third spaced-apart pair of elongated side panels [302], [304 may include another third panel region [414] having a generally flat profile.

In further examples of the example [100] of the lighting system, a one [116] of the second spaced-apart pair of elongated side panels [116], [118] may include a second panel region [416] having a generally flat profile, and a one [202] of the fourth spaced-apart pair of elongated side panels [134], [202] may include a fourth panel region [418] having a generally flat profile, and the pivotable joint assembly [140] may be configured for permitting the one [116] of the second spaced-apart pair of elongated side panels [116], [118] to be in direct contact with the one [202] of the fourth spaced-apart pair of elongated side panels [134], [202]. In additional examples of the example [100] of the lighting system, the second panel region [416] may have second dimensions including a second length represented by the arrow [142] along the first longitudinal axis [106], and a second width [420]; and the fourth panel region [418] may have fourth dimensions including a fourth length represented by the arrow [144] along the second longitudinal axis [128], and a fourth width [422]; and the second width [420] may be smaller than the fourth width [422]. In further examples of the example [100] of the lighting system, a combined width being a sum of the second width [420] and the fourth width [422] of the lighting system may be within a range of between about 35 millimeters and about 50 millimeters; or within a range of between about 20 millimeters and about 100 millimeters. In other examples of the example [100] of the lighting system, another one [118] of the second spaced-apart pair of elongated side panels [116], [118] may include another second panel region [424] having a generally flat profile, and another one [134] of the fourth spaced-apart pair of elongated side panels [134], [202] may include another fourth panel region [426] having a generally flat profile. In some examples of the example [100] of the lighting system, configuring the pivotable joint assembly [140] for permitting the one [116] of the second spaced-apart pair of elongated side panels [116], [118] to be in direct contact with the one [202] of the fourth spaced-apart pair of elongated side panels [134], [202] may include configuring the pivotable joint assembly [140] for permitting the one [116] of the second spaced-apart pair of elongated side panels [116], [118] to be rotated toward the one [202] of the fourth spaced-apart pair of elongated side panels [134], [202] around the pivotable joint axis by an angle represented by the arrow [306] being within a range of between about 0 degrees and about 180 degrees.

In further examples of the example [100] of the lighting system, the one [302] of the third spaced-apart pair of elongated side panels [302], [304] may include the third panel region [406] having a generally flat profile, and the second enclosure [104] may be configured for mounting the example [100] of the lighting system by placing the one [302] of the third spaced-apart pair of elongated side panels [302], [304] in contact with a support. In those further examples of the example [100] of the lighting system, the second enclosure [104] may include mounting holes or brackets (not shown) in the one [302] of the third spaced-apart pair of elongated side panels [302], [304]. In additional examples of the example [100] of the lighting system, another one [304] of the third spaced-apart pair of elongated side panels [302], [304] may include the another third panel region [414] having a generally flat profile, and the second enclosure [104] may be configured for mounting the example [100] of the lighting system by placing the another one [304] of the third spaced-apart pair of elongated side panels [302], [304] in contact with a support. In those additional examples of the example [100] of the lighting system, the second enclosure [104] may include mounting holes or brackets (not shown) in the another one [304] of the third spaced-apart pair of elongated side panels [302], [304]. In further examples of the example [100] of the lighting system, the another one [134] of the fourth spaced-apart pair of elongated side panels [134], [202] may include the fourth panel region [426] having a generally flat profile, and the second enclosure [104] may be configured for mounting the example [100] of the lighting system by placing the another one [134] of the fourth spaced-apart pair of elongated side panels [134], [202] in contact with a support. In those further examples of the example [100] of the lighting system, the second enclosure [104] may include mounting holes or brackets (not shown) in the another one [134] of the fourth spaced-apart pair of elongated side panels [134], [202].

In some examples [100] of the lighting system, the second enclosure [104] may be configured for mounting the lighting system by placing a one of the third spaced-apart pair of elongated side panels [302], [304] in contact with a support. In additional examples [100] of the lighting system, the second enclosure [104] may include a mounting hole in the one of the third spaced-apart pair of elongated side panels [302], [304], and the mounting hole may be adapted for receiving a screw or nail for placing the second enclosure

[104] in contact with a support. In additional examples [100] of the lighting system, the second enclosure [104] may include a plurality of mounting holes in the one of the third spaced-apart pair of elongated side panels [302], [304], and each of the mounting holes may be adapted for receiving a screw or nail for placing the second enclosure [104] in contact with a support.

In further examples of the example [100] of the lighting system, the one [112] of the first spaced-apart pair of elongated side panels [112], [114] may include the first panel region [404] having a generally flat profile and having first dimensions including a first length represented by the arrow [142] along the first longitudinal axis [106], and a first width represented by the arrow [408]. Also in those further examples of the example [100] of the lighting system, the one [116] of the second spaced-apart pair of elongated side panels [116], [118] may include the second panel region [416] having a generally flat profile and having second dimensions including a second length represented by the arrow [142] along the first longitudinal axis [106], and a second width represented by the arrow [420]. Additionally in those further examples of the example [100] of the lighting system, the second width [420] may be substantially smaller than the first width [408].

In additional examples of the example [100] of the lighting system, the one [302] of the third spaced-apart pair of elongated side panels [302], [304] may include the third panel region [406] having a generally flat profile and having third dimensions including a third length represented by the arrow [144] along the second longitudinal axis [128], and a third width represented by the arrow [410]. Also in those additional examples of the example [100] of the lighting system, the one [202] of the fourth spaced-apart pair of elongated side panels [134], [202] may include the fourth panel region [418] having a generally flat profile and having fourth dimensions including a fourth length represented by the arrow [144] along the second longitudinal axis [128], and a fourth width represented by the arrow [422]. Further in those additional examples of the example [100] of the lighting system, the fourth width [422] may be substantially smaller than the second width [420].

Figure 5:
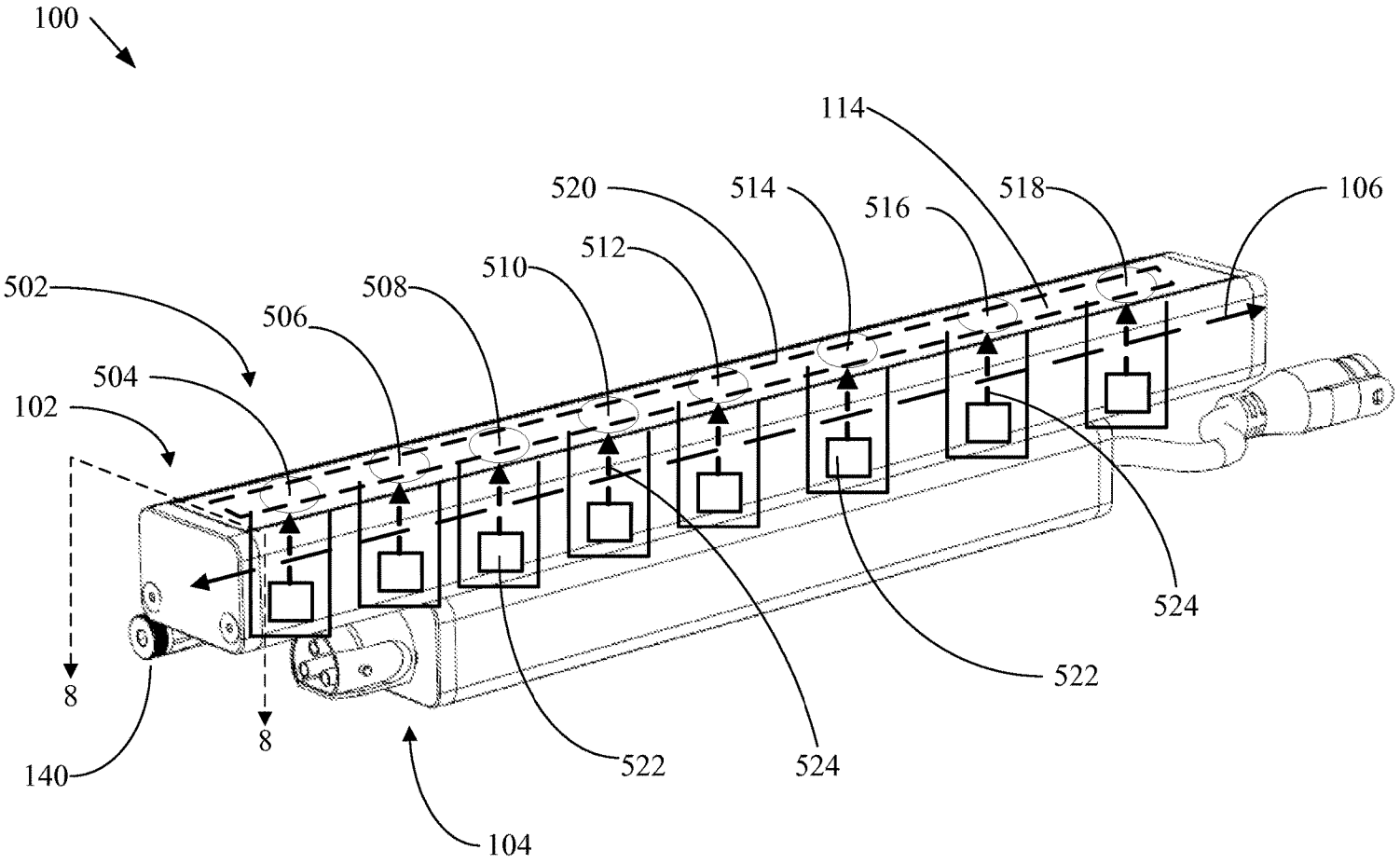
FIG. 5 is another perspective view showing the example [100] of an implementation of a lighting system.
Figure 6:
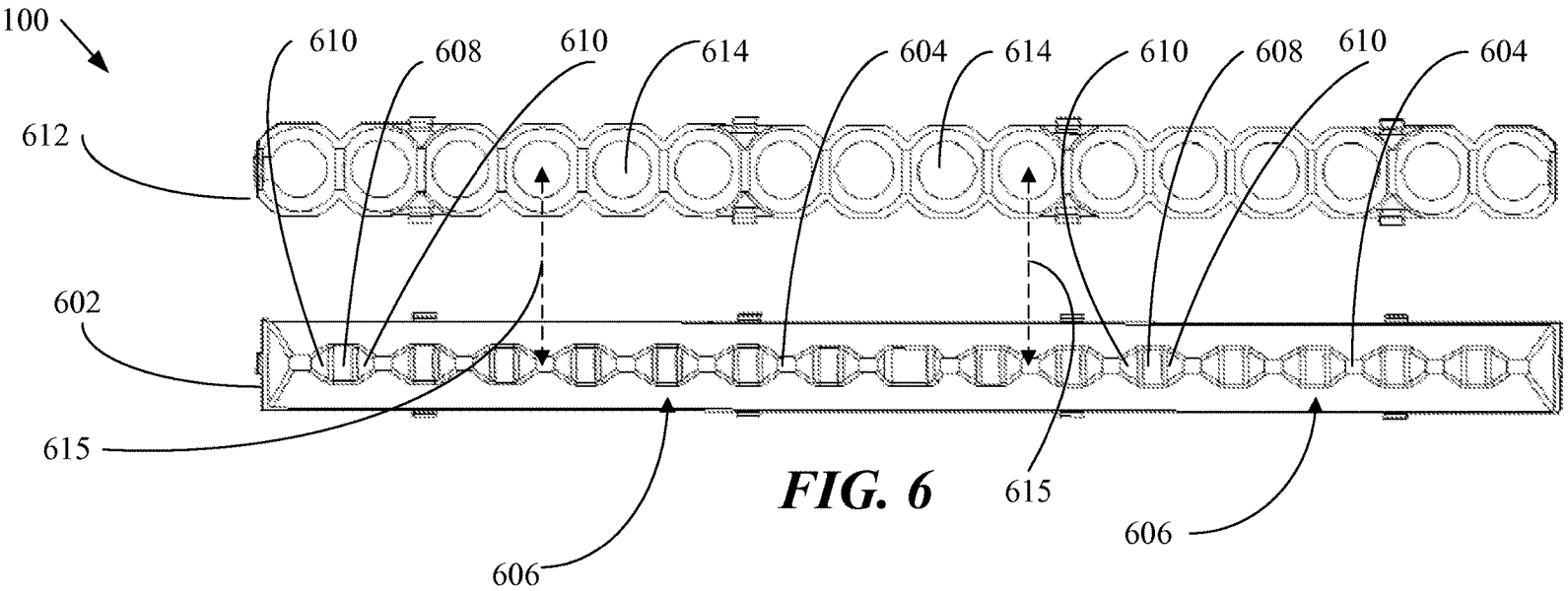
FIG. 6 is a top view showing examples of the carrier and the primary visible light reflector that may be included in the example [100] of an implementation of a lighting system.
Figure 7:
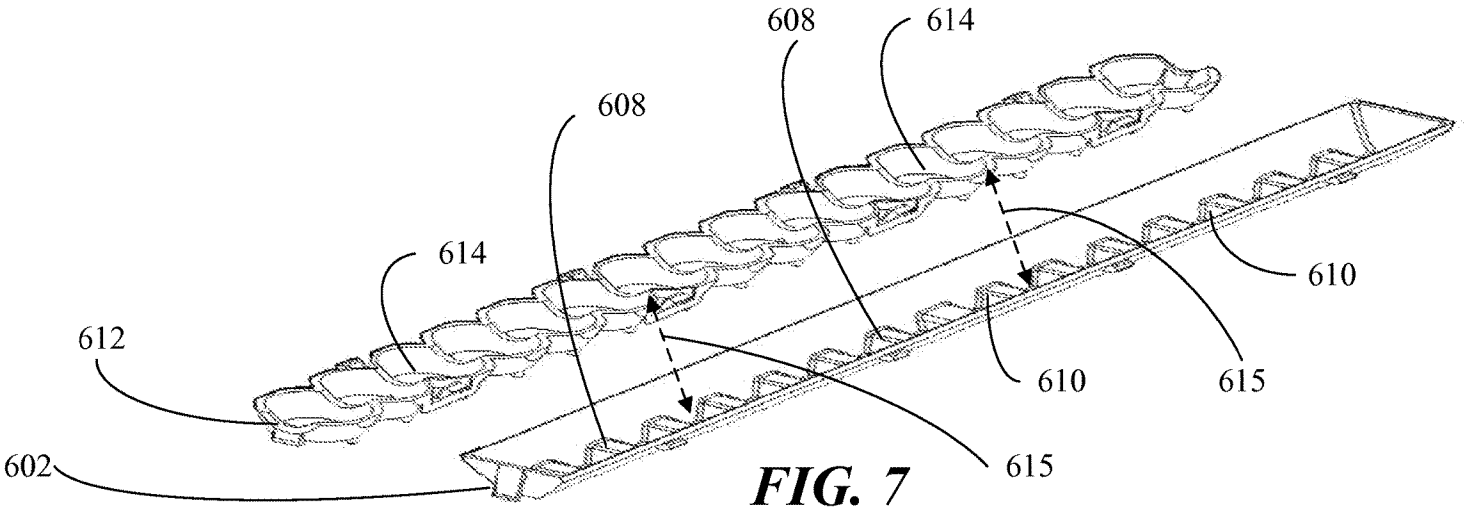
FIG. 7 is a perspective view showing the examples of the carrier and the primary visible light reflector as shown in FIG. 6.
Figure 8:
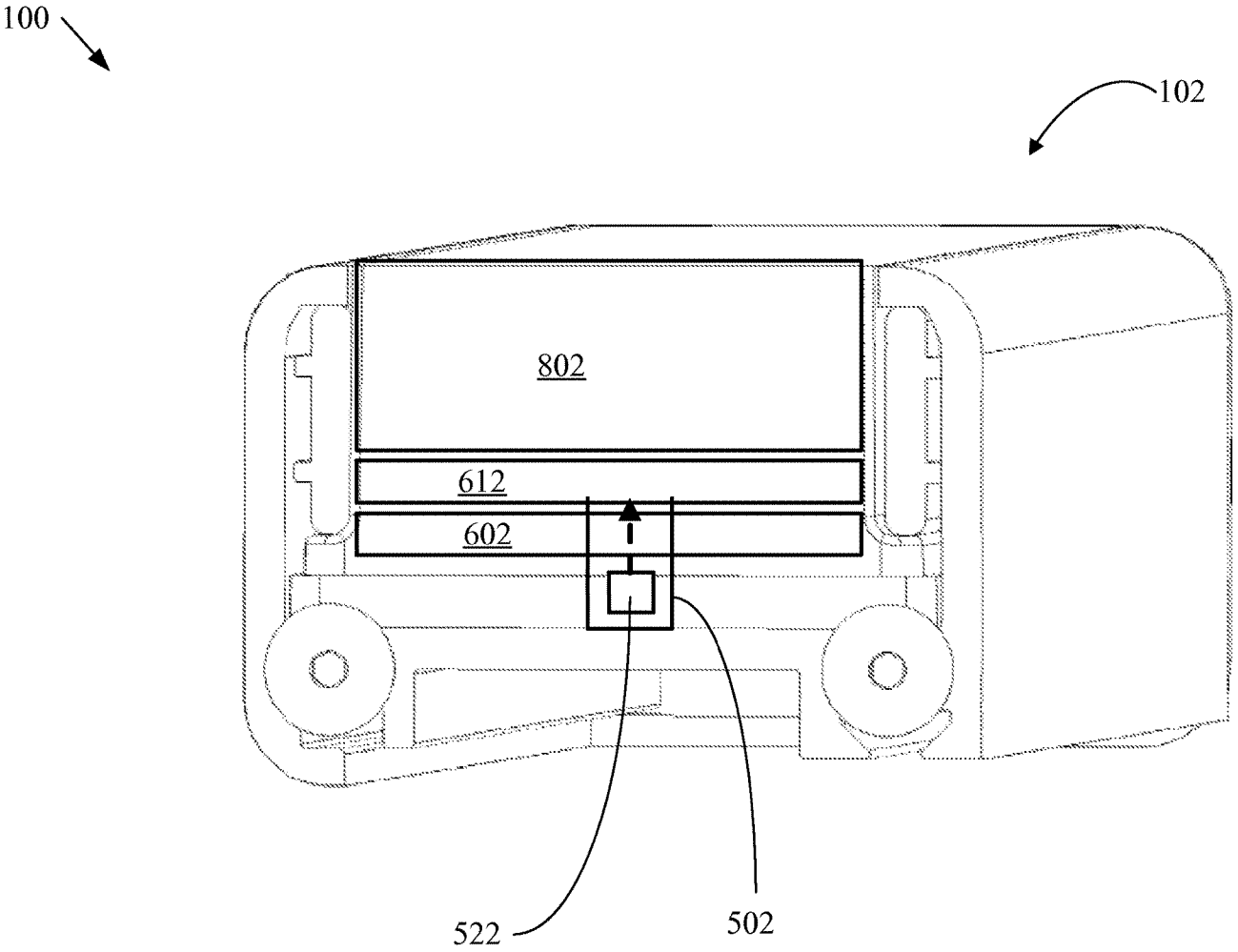
FIG. 8 is a cross-sectional view taken on line 8-8, of the example [100] of the lighting system as shown in FIG. 5.

FIG. 5 is another perspective view showing the example [100] of an implementation of a lighting system. FIG. 6 is a top view showing examples of the carrier and the primary visible light reflector that may be included in the example [100] of an implementation of a lighting system. FIG. 7 is a perspective view showing the examples of the carrier and the primary visible light reflector as shown in FIG. 6. FIG. 8 is a cross-sectional view taken on line 8-8, of the example [100] of the lighting system as shown in FIG. 5. In some examples, the example [100] of the lighting system may include an array [502] of a plurality of lighting modules [504], [506], [508], [510], [512], [514], [516], [518] being mounted in the first enclosure [102], wherein the pivotable joint assembly [140] is configured for permitting a one [112] of the first spaced-apart pair of elongated side panels [112], [114] to face towards a one [302] of the third spaced-apart pair of elongated side panels [302], [304], and the first enclosure [102] may be configured for mounting the array [502] of the plurality of lighting modules [504], [506], [508], [510], [512], [514], [516], [518] for emitting light emissions through the another one [114] of the first spaced-apart pair of elongated side panels [112], [114]. In some examples [100] of the lighting system, the another one [114] of the first spaced-apart pair of elongated side panels [112], [114] may include a first transparent panel region [520], being transparent to visible light, and having a generally flat profile. In additional examples [100] of the lighting system, each one of the plurality of the lighting modules [504], [506], [508], [510], [512], [514], [516], [518] may include a semiconductor light-emitting device [522]. In other examples [100] of the lighting system, each one of the plurality of the lighting modules [504], [506], [508], [510], [512], [514], [516], [518] may have a central light emission axis [524], and each one of the plurality of the lighting modules [504], [506], [508], [510], [512], [514], [516], [518] may be configured for emitting light emissions along the respective central light emission axis [524] of the lighting module [504], [506], [508], [510], [512], [514], [516], [518]. In some examples [100] of the lighting system, the first enclosure [102] may include a primary visible light reflector [602] having a plurality of reflector apertures [604], the plurality of the reflector apertures [604] being spaced apart along the first longitudinal axis [106] and being aligned as represented by arrows [615] with the central light emission axes [524] of the lighting modules [504], [506], [508], [510], [512], [514], [516], [518]. In some examples [100] of the lighting system, the primary visible light reflector [602] may include the plurality of the reflector apertures [604] as being spaced apart in a row along the first longitudinal axis [106]. In further examples [100] of the lighting system, the primary visible light reflector [602] may include the plurality of the reflector apertures [604] as being spaced apart in a plurality of rows along the first longitudinal axis [106]. In additional examples [100] of the lighting system, the primary visible light reflector [602] may include a plurality of reflector elements [606], and each of the reflector elements [606] may include a top reflective surface [608] being located between two tangential reflective surfaces [610], and each of the reflector apertures [604] of the primary visible light reflector [602] may be located between a pair of the reflector elements [606]. In other examples [100] of the lighting system, the first elongated enclosure [102] may include a carrier [612] having a plurality of carrier apertures [614], the plurality of the carrier apertures [614] being spaced apart along the first longitudinal axis [106] and being aligned as represented by the arrows [615] with the central light emission axes [524] of the lighting modules [504], [506], [508], [510], [512], [514], [516], [518], each one of the plurality of the carrier apertures [614] of the carrier [612] being configured and shaped for receiving and mounting a lens module [802]. Suitable lighting modules and lens modules for incorporation into the examples [100] of the lighting system are disclosed in the commonly-owned U.S. patent application Ser. No. 14/636,204, being filed on the same date herewith, entitled "Lighting Systems Including Lens Modules For Selectable Light Distribution," the entirety of which is hereby incorporated herein by reference.

In other examples [100] (not shown), the lighting system may have an array [502] of a plurality of lighting modules [504], [506], [508], [510], [512], [514], [516], [518] being mounted in the first enclosure [102]. In those other examples [100] of the lighting system, the pivotable joint assembly [140] may be configured for permitting the one [112] of the first spaced-apart pair of elongated side panels [112], [114] to face towards the one [302] of the third spaced-apart pair of elongated side panels [302], [304]. Further in those other examples [100] of the lighting system, the first enclosure [102] may be configured for mounting the array [502] of the plurality of lighting modules [504], [506], [508], [510], [512], [514], [516], [518] for emitting light emissions through the one [118] of the second spaced-apart pair of elongated side panels [116], [118].

Figure 9:
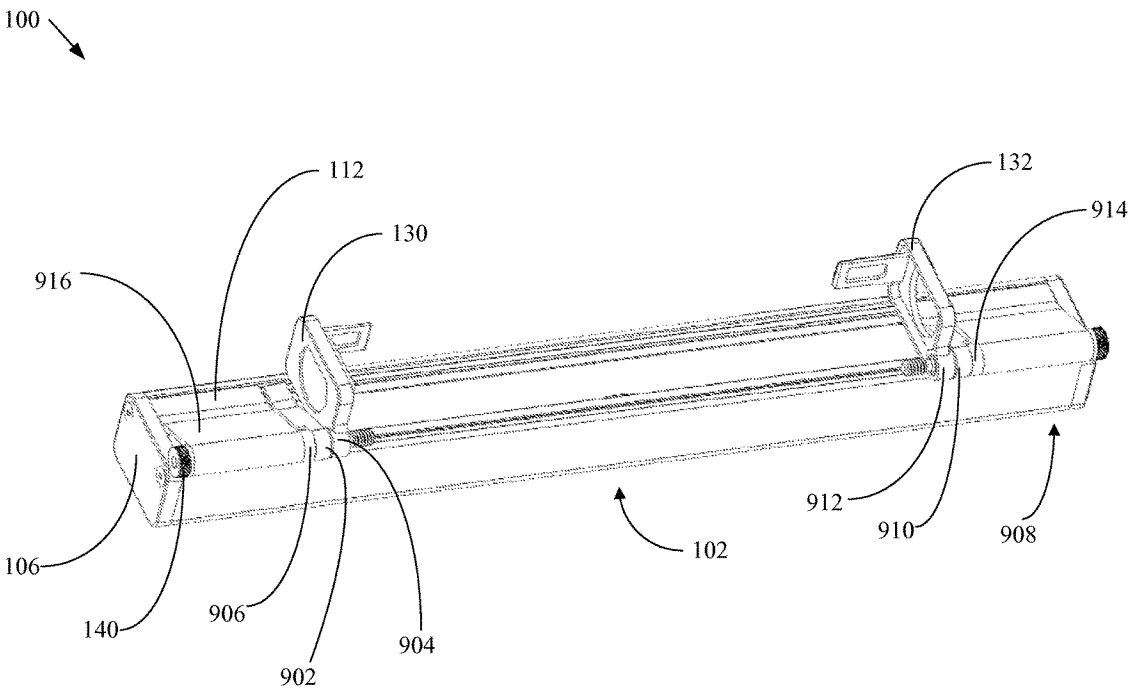
FIG. 9 is a perspective view showing a portion of an example [100] of the lighting system.
Figure 10:
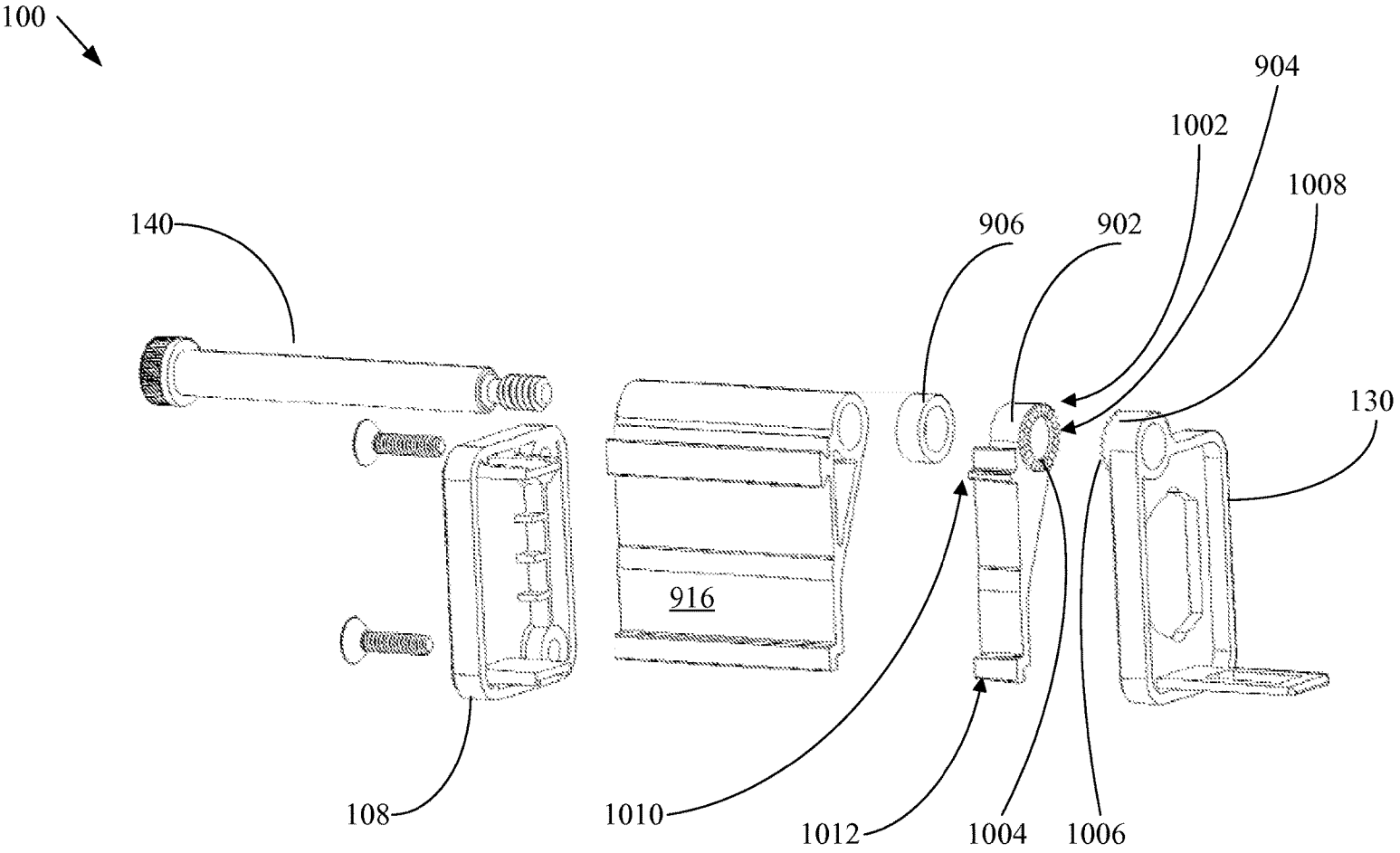
FIG. 10 is another perspective view showing a portion of an example [100] of the lighting system.
Figure 11:
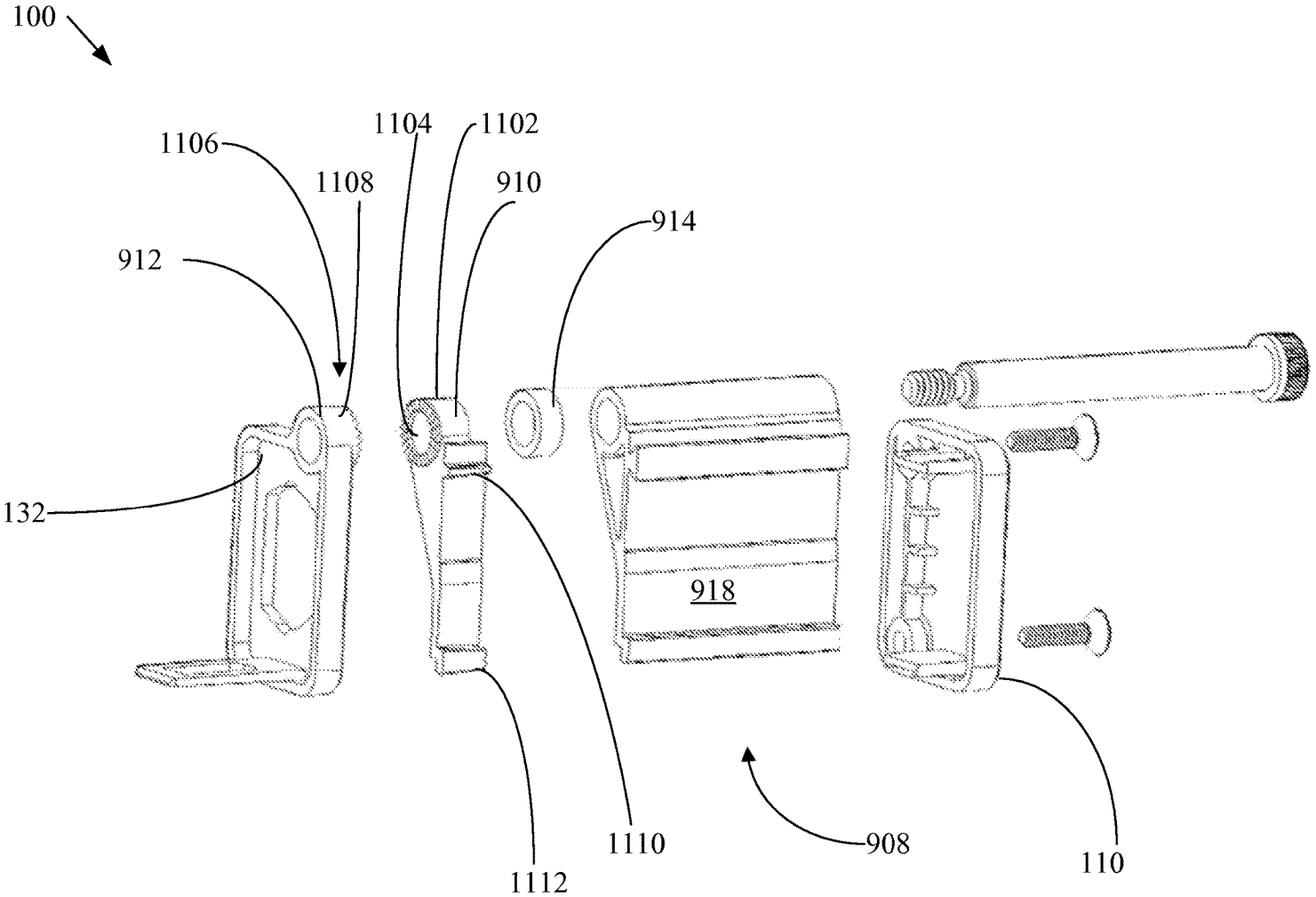
FIG. 11 is a further perspective view showing a portion of an example [100] of the lighting system.
Figure 12:
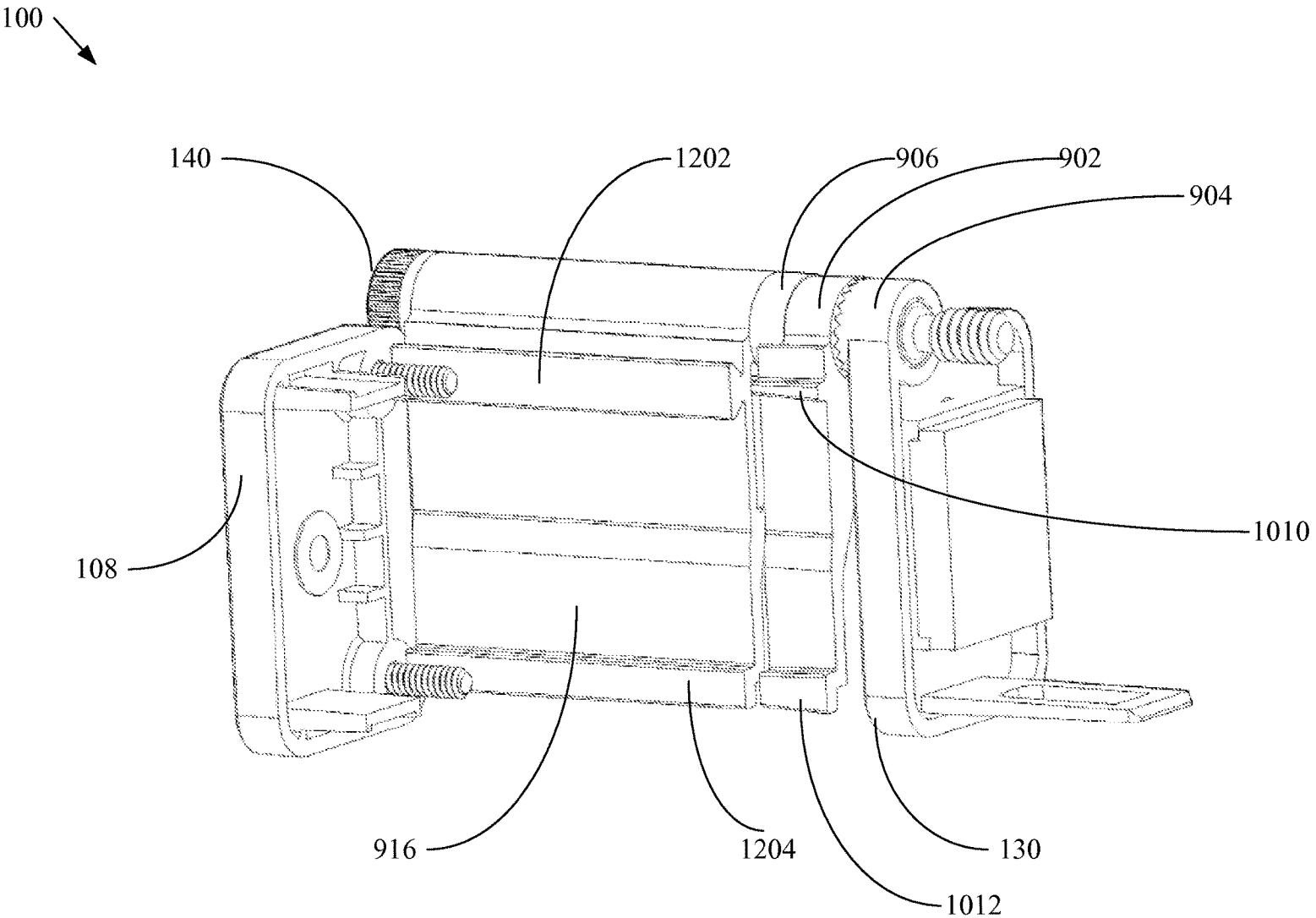
FIG. 12 is an additional perspective view showing a portion of an example [100] of the lighting system.
Figure 13:
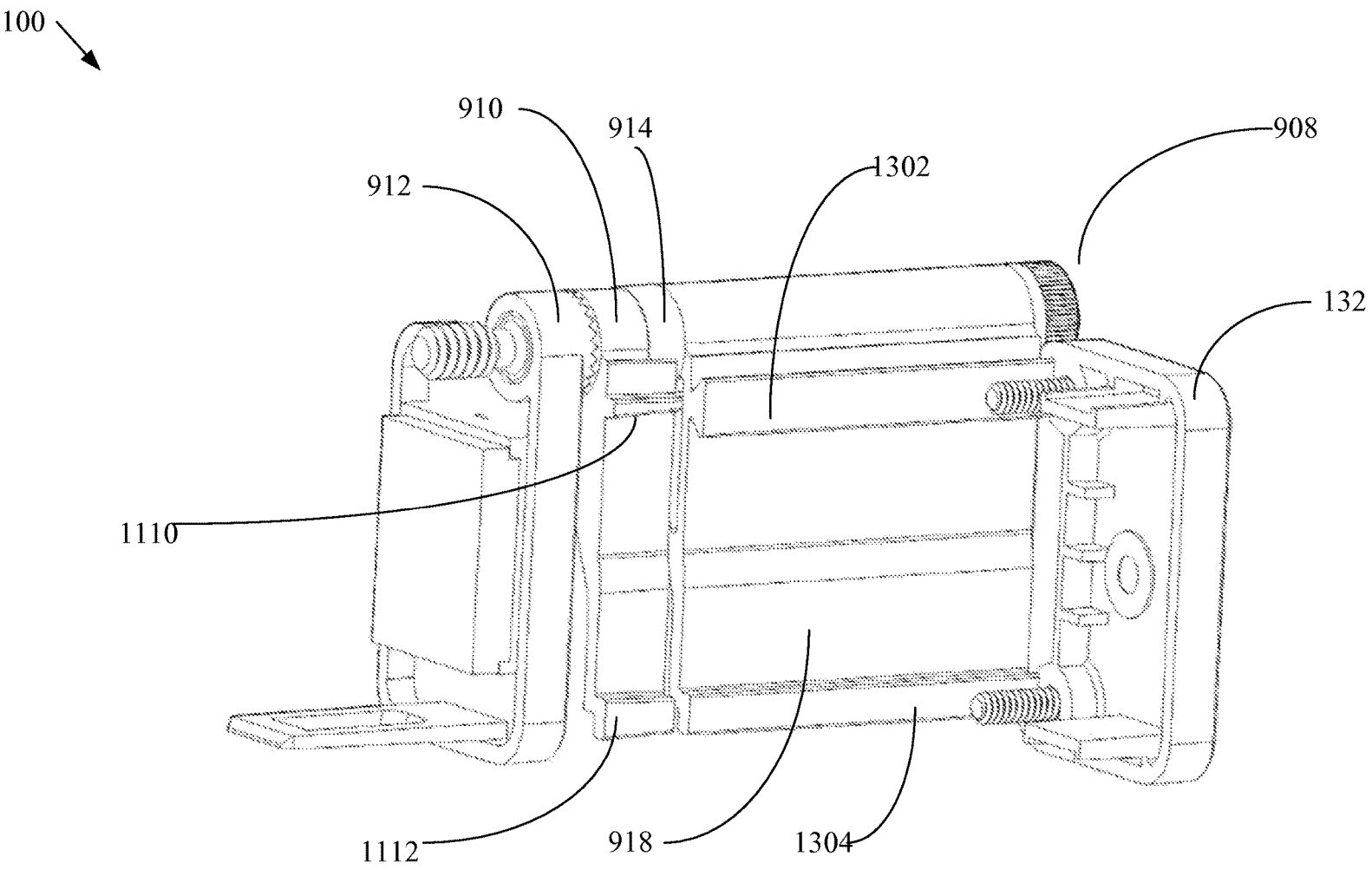
FIG. 13 is another perspective view showing a portion of an example [100] of the lighting system.
Figure 14:
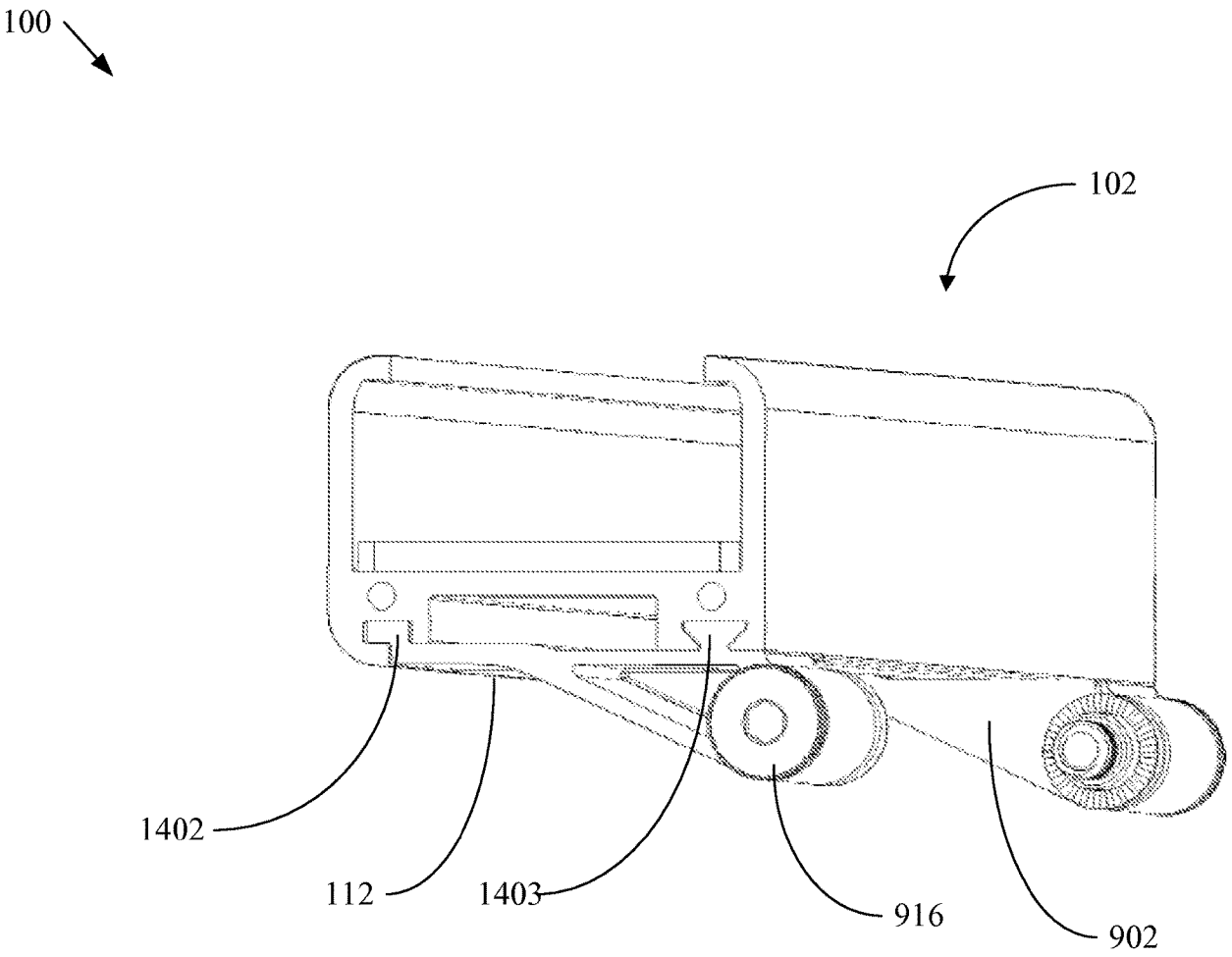
FIG. 14 is another perspective view showing a portion of an example [100] of the lighting system.

FIG. 9 is a perspective view showing a portion of an example [100] of the lighting system. FIG. 10 is another perspective view showing a portion of an example [100] of the lighting system. FIG. 11 is a further perspective view showing a portion of an example [100] of the lighting system. FIG. 12 is an additional perspective view showing a portion of an example [100] of the lighting system. FIG. 13 is another perspective view showing a portion of an example [100] of the lighting system. FIG. 14 is another perspective view showing a portion of an example [100] of the lighting system. In some examples [100] of the lighting system, the pivotable joint assembly [140] may include a first pivot joint element [902] being attached to the first enclosure [102], and a second pivot joint element [904] being attached to the second enclosure [104]. In those examples [100] of the lighting system, the first pivot joint element [902] and the second pivot joint element [904] may be configured for cooperatively securing the one [112] of the first spaced-apart pair of elongated side panels [112], [114] at a position represented by the arrow [306] being located away from the one [302] of the third spaced-apart pair of elongated side panels [302], [304] by an angle around the pivotable joint axis. Further in those examples [100] of the lighting system, the one [112] of the first spaced-apart pair of elongated side panels [112], [114] may be secured at a position being located away from the one [302] of the third spaced-apart pair of elongated side panels [302], [304] around the pivotable joint axis [206] by an angle being within the range of between about 0 degrees and about 180 degrees.

In some examples [100] of the lighting system, the first pivot joint element [902] may include a first circular disc [1002] having a first flat side [1004] with raised features, and the second pivot joint element [904] may include a second circular disc [1006] having a second flat side [1008] with raised features, and the pivotable joint assembly [140] may be configured for placing the first flat side [1004] of the first circular disc [1002] in direct contact with the second flat side [1008] of the second circular disc [1006]. In further examples [100] of the lighting system, the raised features of the first and second flat sides [1004], [1008] of the first and second circular discs [1002], [1006] may each include a circular pattern of alternating radially extending crests and valleys having a uniform contour. In additional examples [100] of the lighting system, the pivotable joint assembly [140] may include a spring [906] being configured for biasing the first flat side [1004] of the first circular disc [1002] as being in direct contact with the second flat side [1008] of the second circular disc [1006].

In other examples [100] of the lighting system, first pivot joint element [902] may include a first circular clutch plate (not shown), and the second pivot joint element [904] may include a second circular clutch plate (not shown), and the pivotable joint assembly [140] may be configured for placing the first clutch plate in direct contact with the second clutch plate. Further in those other examples [100] of the lighting system, (not shown), the first clutch plate may include first frictional pad, and the second clutch plate may include a second frictional pad, and the pivotable joint assembly [140] may be configured for placing the first frictional pad in direct contact with the second frictional pad.

In some examples [100], the lighting system may include another pivotable joint assembly [908] that may include a third pivot joint element [910] being attached to the first enclosure [102] and that may include a fourth pivot joint element [912] being attached to the second enclosure [104]. In those examples [100] of the lighting system, the third and fourth pivot joint elements [910], [912] may be configured for cooperatively securing the one [112] of the first spaced-apart pair of elongated side panels [112], [114] at a position being located away from the one [302] of the third spaced-apart pair of elongated side panels [302], [304] around the pivotable joint axis by an angle around the pivotable joint axis. Further in those examples [100] of the lighting system, the one [112] of the first spaced-apart pair of elongated side panels [112], [114] may be secured at a position being located away from the one [302] of the third spaced-apart pair of elongated side panels [302], [304] around the pivotable joint axis [206] by an angle being within the range of between about 0 degrees and about 180 degrees.

In further examples [100] of the lighting system, third pivot joint element [910] may include a third circular disc [1102] having a third flat side [1104] with raised features, and the fourth pivot joint element [912] may include a fourth circular disc [1106] having a fourth flat side [1108] with raised features, and the another pivotable joint assembly [908] may be configured for placing the third flat side [1104] of the third circular disc [1102] in direct contact with the fourth flat side [1108] of the fourth circular disc [1106]. In some examples [100] of the lighting system, the raised features of the third and fourth flat sides [1104], [1108] of the third and fourth circular discs [1102], [1106] may each include a circular pattern of alternating radially extending crests and valleys having a uniform contour. In further examples [100] of the lighting system, the another pivotable joint assembly [908] may include another spring [914] being configured for biasing the third flat side [1104] of the third circular disc [1102] as being in direct contact with the fourth flat side [1108] of the fourth circular disc [1106].

In some examples [100] of the lighting system, the second pivot joint element [904] may be attached to the end panel [130] of the second enclosure [104], and the fourth pivot joint element [912] may be attached to the another one of the end panels [132] of the second enclosure [104]. In further examples [100] of the lighting system, each of the first and third pivot joint elements [902], 910] may be attached to the one [112] of the first spaced-apart pair of elongated side panels [112], [114].

In additional examples [100] of the lighting system, the one [112] of the first spaced-apart pair of elongated side panels [112], [114] may include a support plate [916] attached to the pivotable joint assembly [140]; and may include another support plate [918] attached to the another pivotable joint assembly [908]. In some examples [100] of the lighting system, the support plate [916] may include a raised rib [1202] being spaced apart from a raised lip [1204], being configured for attaching the support plate [916] to the one [112] of the first spaced-apart pair of elongated side panels [112], [114]. In further examples [100] of the lighting system, the support plate [918] may include a raised rib [1302] being spaced apart from a raised lip [1304], being configured for attaching the support plate [918] to the one [112] of the first spaced-apart pair of elongated side panels [112], [114]. Additionally in those examples [100] of the lighting system, the one [112] of the first spaced-apart pair of elongated side panels [112], [114] may include two spaced-apart tracks [1402], [1403] configured for receiving the raised rib [1202] and the raised lip [1204]; and two spaced-apart tracks (not shown) configured for receiving the raised rib [1302] and the raised lip [1304]. In other examples [100] of the lighting system, the first pivot joint element [902] may include a raised rib [1010] being spaced apart from a raised lip [1012], being configured for attaching the first pivot joint element [902] to the one [112] of the first spaced-apart pair of elongated side panels [112], [114]. In additional examples [100] of the lighting system, the third pivot joint element [910] may include a raised rib [1110] being spaced apart from a raised lip [1112], being configured for attaching the third pivot joint element [910] to the one [112] of the first spaced-apart pair of elongated side panels [112], [114].

The examples [100] of lighting systems may generally be utilized in end-use applications where an array of lighting modules are needed, enabling a lighting system to be easily and repeatedly adjusted in order to direct light emissions in a range of directions.

While the present invention has been disclosed in a presently defined context, it will be recognized that the present teachings may be adapted to a variety of contexts consistent with this disclosure and the claims that follow. For example, the lighting systems shown in the figures and discussed above can be adapted in the spirit of the many optional parameters described.

What is claimed is:

1. A lighting system, comprising:

a first enclosure being elongated along a first longitudinal axis and being configured for mounting an array of a plurality of lighting modules, the first enclosure including: two opposing end panels being spaced apart along the first longitudinal axis; a first spaced-apart pair of opposing elongated side panels; a second spaced-apart pair of opposing elongated side panels; and four elongated enclosure edges joining together the first and second pairs of the elongated side panels along the first longitudinal axis;

a second enclosure being elongated along a second longitudinal axis and containing a lighting module power supply, the lighting module power supply being configured for supplying power in the first enclosure to such plurality of lighting modules, the second enclosure including: two additional opposing end panels being spaced apart along the second longitudinal axis; a third spaced-apart pair of opposing elongated side panels; a fourth spaced-apart pair of opposing elongated side panels; and four additional elongated enclosure edges joining together the third and fourth pairs of the elongated side panels along the second longitudinal axis;

a pivotable joint assembly including a first pivot joint element being attached to a one of the first spaced-apart pair of elongated side panels of the first enclosure and including a second pivot joint element being attached to a one of the end panels of the second enclosure, the pivotable joint assembly having a pivotable joint axis, the pivotable joint axis being parallel with the first and second longitudinal axes, the pivotable joint assembly being interposed between a one of the elongated enclosure edges and a one of the additional elongated enclosure edges and being configured for constraining movement of the first longitudinal axis relative to the second longitudinal axis as being around and parallel with the pivotable joint axis.

2. The lighting system of claim 1, wherein the one of the first spaced-apart pair of elongated side panels includes a support plate being attached to the pivotable joint assembly.

3. The lighting system of claim 2, wherein the support plate includes a raised rib being spaced apart from a raised lip, being configured for attaching the support plate to the one of the first spaced-apart pair of elongated side panels; and wherein the one of the first spaced-apart pair of elongated side panels includes two spaced-apart tracks configured for receiving the raised rib and the raised lip.

4. The lighting system of claim 3, wherein the first pivot joint element includes another raised rib being spaced apart from another raised lip, being configured for attaching the first pivot joint element to the one of the first spaced-apart pair of elongated side panels.

5. The lighting system of claim 1, having another pivotable joint assembly including a third pivot joint element being attached to the first enclosure and a fourth pivot joint element being attached to another one of the end panels of the second enclosure.

6. The lighting system of claim 5, wherein the third pivot joint element is attached to the one of the first spaced-apart pair of elongated side panels.

7. The lighting system of claim 6, wherein the one of the first spaced-apart pair of elongated side panels includes another support plate being attached to the another pivotable joint assembly.

8. The lighting system of claim 7, wherein the another support plate includes a further raised rib being spaced apart from a further raised lip, being configured for attaching the another support plate to the one of the first spaced-apart pair of elongated side panels; and wherein the two spaced-apart tracks are configured for receiving the further raised rib and the further raised lip.

9. The lighting system of claim 8, wherein the third pivot joint element includes an additional raised rib being spaced apart from an additional raised lip, being configured for attaching the third pivot joint element to the one of the first spaced-apart pair of elongated side panels.

10. The lighting system of claim 1, wherein the pivotable joint assembly is configured for permitting a one of the first spaced-apart pair of elongated side panels to face towards a one of the third spaced-apart pair of elongated side panels, and wherein the one of the first spaced-apart pair of elongated side panels includes a first panel region having a generally flat profile, and wherein the one of the third spaced-apart pair of elongated side panels includes a third panel region having a generally flat profile, and wherein the pivotable joint assembly is configured for permitting the one of the first spaced-apart pair of elongated side panels to be in direct contact with the one of the third spaced-apart pair of elongated side panels.

11. The lighting system of claim 10, wherein the pivotable joint assembly is configured for permitting a one of the second spaced-apart pair of elongated side panels to face towards a one of the fourth spaced-apart pair of elongated side panels, and wherein the one of the second spaced-apart pair of elongated side panels includes a second panel region having a generally flat profile, and wherein the one of the fourth spaced-apart pair of elongated side panels includes a fourth panel region having a generally flat profile, and wherein the pivotable joint assembly is configured for permitting the one of the second spaced-apart pair of elongated side panels to be in direct contact with the one of the fourth spaced-apart pair of elongated side panels.

12. The lighting system of claim 1, wherein the pivotable joint assembly is configured for permitting a one of the first spaced-apart pair of elongated side panels to face towards a one of the third spaced-apart pair of elongated side panels, and wherein the one of the third spaced-apart pair of elongated side panels includes a third panel region having a generally flat profile, and wherein the second enclosure is configured for mounting the lighting system by placing the one of the third spaced-apart pair of elongated side panels in contact with a support.

13. The lighting system of claim 12, wherein another one of the third spaced-apart pair of elongated side panels includes another third panel region having a generally flat profile, and wherein the second enclosure is configured for mounting the lighting system by placing the another one of the third spaced-apart pair of elongated side panels in contact with a support.

14. The lighting system of claim 1, wherein a one of the fourth spaced-apart pair of elongated side panels includes a fourth panel region having a generally flat profile, and wherein the second enclosure is configured for mounting the lighting system by placing the one of the fourth spaced-apart pair of elongated side panels in contact with a support.

15. The lighting system of claim 1, wherein a one of the first spaced-apart pair of elongated side panels includes a first panel region having a generally flat profile having first dimensions including a first length along the first longitudinal axis, and a first width; and wherein a one of the second spaced-apart pair of elongated side panels includes a second panel region having a generally flat profile having second dimensions including a second length along the first longitudinal axis, and a second width; and wherein the second width is substantially smaller than the first width.

16. The lighting system of claim 1, wherein a one of the third spaced-apart pair of elongated side panels includes a third panel region having a generally flat profile having third dimensions including a third length along the second longitudinal axis, and a third width;

and wherein a one of the fourth spaced-apart pair of elongated side panels includes a fourth panel region having a generally flat profile having fourth dimensions including a fourth length along the second longitudinal axis, and a fourth width; and wherein the fourth width is substantially smaller than the second width.

17. The lighting system of claim 1 further having an array of a plurality of lighting modules being mounted in the first enclosure.

18. The lighting system of claim 1, wherein a one of the first spaced-apart pair of elongated side panels includes a first transparent panel region having a generally flat profile.

19. The lighting system of claim 17, wherein each one of the plurality of the lighting modules includes a semiconductor light-emitting device.

20. The lighting system of claim 19, wherein each one of the plurality of the lighting modules has a central light emission axis, and wherein each one of the plurality of the lighting modules is configured for emitting light emissions along the central light emission axis of the lighting module.

21. The lighting system of claim 20, wherein the first enclosure includes a primary visible light reflector having a plurality of reflector apertures, the plurality of the reflector apertures being spaced apart along the first longitudinal axis and being aligned with the central light emission axes of the lighting modules.

22. The lighting system of claim 21, wherein the primary visible light reflector includes the plurality of the reflector apertures as being spaced apart in a row along the first longitudinal axis.

23. The lighting system of claim 21, wherein the primary visible light reflector includes the plurality of the reflector apertures as being spaced apart in a plurality of rows along the first longitudinal axis.

24. The lighting system of claim 21, wherein the primary visible light reflector includes a plurality of reflector elements, and wherein each of the reflector elements includes a top reflective surface being located between two tangential reflective surfaces, and wherein each of the reflector apertures of the primary visible light reflector is located between a pair of the reflector elements.

25. The lighting system of claim 21, wherein the first enclosure includes a carrier having a plurality of carrier apertures, the plurality of the carrier apertures being spaced apart along the first longitudinal axis and being aligned with the central light emission axes of the lighting modules, each one of the plurality of the carrier apertures of the carrier being configured and shaped for receiving and mounting a lens module.

26. The lighting system of claim 1 further having an array of a plurality of lighting modules being mounted in the first enclosure, wherein the pivotable joint assembly is configured for permitting a one of the first spaced-apart pair of elongated side panels to face towards a one of the third spaced-apart pair of elongated side panels, and wherein the first enclosure is configured for mounting the array of the plurality of lighting modules for emitting light emissions through a one of the first spaced-apart pair of elongated side panels or through a one of the second spaced-apart pair of elongated side panels.

27. The lighting system of claim 1, wherein the first and second pivot joint elements are configured for cooperatively securing a one of the first spaced-apart pair of elongated side panels at a position being located away from a one of the third spaced-apart pair of elongated side panels around the pivotable joint axis by an angle being within the range of between about 0 degrees and about 180 degrees.

28. The lighting system of claim 1, wherein the first and second pivot joint elements are configured for cooperatively securing a one of the first spaced-apart pair of elongated side panels at a position being located away from a one of the third spaced-apart pair of elongated side panels by an angle around the pivotable joint axis.

29. The lighting system of claim 1, wherein the first pivot joint element includes a first circular disc having a first flat side with raised features, and wherein the second pivot joint element includes a second circular disc having a second flat side with raised features, and wherein the pivotable joint assembly is configured for placing the first flat side of the first circular disc in direct contact with the second flat side of the second circular disc.

30. The lighting system of claim 29, wherein the raised features of the first and second flat sides of the first and second circular discs each include a circular pattern of alternating radially extending crests and valleys having a uniform contour.

31. The lighting system of claim 29, wherein the pivotable joint assembly includes a spring being configured for biasing the first flat side of the first circular disc as being in direct contact with the second flat side of the second circular disc.

32. The lighting system of claim 1, wherein the first pivot joint element includes a first circular clutch plate, and wherein the second pivot joint element includes a second circular clutch plate, and wherein the pivotable joint assembly is configured for placing the first clutch plate in direct contact with the second clutch plate.

33. The lighting system of claim 32, wherein the first clutch plate includes a first frictional pad, and wherein the second clutch plate includes a second frictional pad, and wherein the pivotable joint assembly is configured for placing the first frictional pad in direct contact with the second frictional pad.

34. The lighting system of claim 5, wherein the third and fourth pivot joint elements are configured for cooperatively securing a one of the first spaced-apart pair of elongated side panels at a position being located away from a one of the third spaced-apart pair of elongated side panels around the pivotable joint axis by an angle within the range of between about 0 degrees and about 180 degrees.

35. The lighting system of claim 5, wherein the third and fourth pivot joint elements are configured for cooperatively securing a one of the first spaced-apart pair of elongated side panels at a position being located away from a one of the third spaced-apart pair of elongated side panels by an angle around the pivotable joint axis.

36. The lighting system of claim 5, wherein the third pivot joint element includes a third circular disc having a third flat side with raised features, and wherein the fourth pivot joint element includes a fourth circular disc having a fourth flat side with raised features, and wherein the another pivotable joint assembly is configured for placing the third flat side of the third circular disc in direct contact with the fourth flat side of the fourth circular disc.

37. The lighting system of claim 36, wherein the raised features of the third and fourth flat sides of the third and fourth circular discs each include a circular pattern of alternating radially extending crests and valleys having a uniform contour.

38. The lighting system of claim 26, wherein the another pivotable joint assembly includes another spring being configured for biasing the third flat side of the third circular disc as being in direct contact with the fourth flat side of the fourth circular disc.

39. The lighting system of claim 1, wherein the second enclosure is configured for mounting the lighting system by placing a one of the third spaced-apart pair of elongated side panels in contact with a support.

40. The lighting system of claim 39, wherein the second enclosure includes a mounting hole in the one of the third spaced-apart pair of elongated side panels, and wherein the mounting hole is adapted for receiving a screw or nail for placing the second enclosure in contact with a support.

41. The lighting system of claim 39, wherein the second enclosure includes a plurality of mounting holes in the one of the third spaced-apart pair of elongated side panels, and wherein each of the mounting holes is adapted for receiving a screw or nail for placing the second enclosure in contact with a support.

42. The lighting system of claim 1, wherein the pivotable joint assembly is configured for: permitting a one of the first spaced-apart pair of elongated side panels to face towards a one of the third spaced-apart pair of elongated side panels; and for permitting a one of the second spaced-apart pair of elongated side panels to face towards a one of the fourth spaced-apart pair of elongated side panels; and for permitting the one of the first spaced-apart pair of elongated side panels to be rotated away from the one of the third spaced-apart pair of elongated side panels around the pivotable joint axis by an angle being within a range of between about 0 degrees and about 180 degrees.

43. The lighting system of claim 42, wherein the pivotable joint assembly is configured for permitting the one of the second spaced-apart pair of elongated side panels to be rotated toward the one of the fourth spaced-apart pair of elongated side panels around the pivotable joint axis by an angle being within a range of between about 0 degrees and about 180 degrees.

44. The lighting system of claim 10, wherein another one of the first spaced-apart pair of elongated side panels includes another first panel region having a generally flat profile, and wherein another one of the third spaced-apart pair of elongated side panels includes another third panel region having a generally flat profile.

45. The lighting system of claim 10, wherein the first panel region has first dimensions including a first length along the first longitudinal axis, and a first width; and wherein the third panel region has third dimensions including a third length along the second longitudinal axis, and a third width; and wherein the first width is substantially the same as the third width.

46. The lighting system of claim 11, wherein the second panel region has second dimensions including a second length along the first longitudinal axis, and a second width; and wherein the fourth panel region has fourth dimensions including a fourth length along the second longitudinal axis, and a fourth width; and wherein the second width is smaller than the fourth width.

47. The lighting system of claim 46, wherein a combined width, being a sum of the second and fourth widths of the lighting system, is within a range of between about 35 millimeters and about 50 millimeters.

* * * * *